US008333418B2

(12) United States Patent
Gosai

(10) Patent No.: US 8,333,418 B2
(45) Date of Patent: Dec. 18, 2012

(54) ACTIVATED CHOPSTICKS

(75) Inventor: Prakash Gosai, Leicester (GB)

(73) Assignee: Dragonsticks Limited, Leicester (GB)

( * ) Notice: Subject to any disclaimer, the term of this patent is extended or adjusted under 35 U.S.C. 154(b) by 9 days.

(21) Appl. No.: 12/996,605

(22) PCT Filed: Apr. 6, 2009

(86) PCT No.: PCT/GB2009/000904

§ 371 (c)(1),
(2), (4) Date: Dec. 6, 2010

(87) PCT Pub. No.: WO2009/147364

PCT Pub. Date: Dec. 10, 2009

(65) Prior Publication Data

US 2011/0127787 A1 Jun. 2, 2011

(30) Foreign Application Priority Data

Jun. 6, 2008 (GB) ..... 0810328.5

(51) Int. Cl.
*A47G 21/10* (2006.01)

(52) U.S. Cl. ..... 294/218; 294/99.2

(58) Field of Classification Search ..... 294/99.2, 294/218, 16

See application file for complete search history.

(56) References Cited

U.S. PATENT DOCUMENTS

| | | | | |
|---|---|---|---|---|
| 3,323,825 | A | 6/1967 | Arima | |
| 3,807,781 | A * | 4/1974 | Rollband | 294/104 |
| 4,312,530 | A | 1/1982 | Young | |
| 5,697,659 | A * | 12/1997 | Calagui | 294/99.2 |
| 6,494,517 | B1 * | 12/2002 | Durant | 294/99.2 |
| 7,052,061 | B2 * | 5/2006 | Calagui | 294/99.2 |
| 7,234,745 | B1 * | 6/2007 | Tsai | 294/99.2 |

FOREIGN PATENT DOCUMENTS

| | | | |
|---|---|---|---|
| CH | 361370 | A | 4/1962 |
| DE | 20220151 | U1 | 3/2003 |
| DE | 202007004331 | U1 | 4/2008 |
| FR | 970972 | A | 1/1951 |
| FR | 1056175 | A | 2/1954 |
| FR | 1213339 | A | 3/1960 |
| JP | 55016676 | U | 2/1980 |
| JP | 2003275085 | A | 9/2003 |

OTHER PUBLICATIONS

Vistisen, Lars, International Search Report for PCT/GB2009/000904, Feb. 4, 2010.

* cited by examiner

*Primary Examiner* — Saul Rodriguez
*Assistant Examiner* — Gabriela Puig
(74) *Attorney, Agent, or Firm* — Chernoff Vilhauer McClung Stenzel LLP

(57) ABSTRACT

An implement (800) for use in the consumption of food includes a pair of elongate members (820, 822) having a first end for contacting the food and a second end for applying a pressure to operate the implement. The elongate members are pivotable with respect to each other. The implement is urged to a storing position in which the first ends of the elongate members are in close proximity to each other and the second ends are spaced apart so that as pressure is applied to the second ends of the elongate members (820, 822) the elongate members pivot with respect to each other separating the first ends and enabling food to be located there between. When the pressure is released the food is gripped by the first ends of the elongate members and can be lifted.

16 Claims, 22 Drawing Sheets

ACTIVATED CHOPSTICKS

CROSS-REFERENCE TO RELATED APPLICATIONS

This is a national stage application filed under 35 USC 371 based on International Application No. PCT/GB2009/000904 filed Apr. 6, 2009, and claims priority under 35 USC 119 of United Kingdom Patent Application No. GB 0810328.5 filed Jun. 6, 2008.

BACKGROUND OF THE INVENTION

This invention relates to a means for use in the consumption of food, and, in particular, to an implement that enables food to be easily lifted and held for consumption in a controlled manner.

There are several different types of eating implements available in the market place ranging from the standard western knife, fork and spoon to the Chinese, and far eastern, chopsticks. Each culture is skilled in using their own types of eating implements, and there is little cross over between cultures.

There are advantages and disadvantages with each type of eating implement and each culture is adept in using their own type of implements. Chopsticks seem to provide the most adaptable and manipulative means for the consumption of food, allowing the food to be lifted to the mouth for consumption without penetration or damage of the food. The drawback with Chopsticks is that they are not simple to use, and require good dexterity and hand eye co-ordination. This has had an impact on usage made of chopsticks in the western cultures.

In addition, there are a number of types of food in western culture which are particularly difficult to eat using conventional chopsticks, such as, for example, sandwiches, pizza, burgers or the like. Certain types of popular foods, such as chicken drumsticks or the like, are awkward to eat using conventional chopsticks due to their size and/or shape. Thus it is often required that a person eats such foodstuffs using either a knife and fork or else their hands. The use of a knife and fork is disadvantageous when compared to chopsticks since it is a two handed operation.

The present invention is aimed at providing an adapted stick arrangement which offers simple and convenient use in the consumption of food.

SUMMARY OF THE INVENTION

In accordance with the present invention there is provided an implement for use in the consumption of food, said implement comprising a pair of elongate members having a first end for contacting the food and a second end for applying a pressure to operate the implement, which elongate members are pivotable with respect to each other; and means for urging the implement to a storing position wherein in the storing position the first ends of the elongate members are in close proximity to each other and the second ends are spaced apart so that as pressure is applied to the second ends of the elongate members the elongate members pivot with respect to each other separating the first ends and enabling food to be located there between so that when the pressure is released the food is gripped by the first ends of the elongate members and can be lifted.

The eating implement can be used to lift all sizes, shapes and types of food from the delicate to the resilient provided that the elongate members can be sufficiently spread to encompass the food piece.

There are several factors to be considered in sizing the eating implement and these include:

- the length of the elongate member below the pivot to the first end;
- the angle of spread of the elongate members and therefore also the stretch that is being applied to the means to urge; and
- the angle of operation of the means to urge.

The limitation to the size of food that may be lifted is dictated by the separation that is achievable at the first end of the elongate members. An envisaged arrangement would have two elongate members moveable in the same plane, and therefore the limit of opening at the first ends of the elongate members would be reached when the second ends of the elongate members came into contact each other.

In one arrangement of the present invention the elongate members are straight members that are caused to move with to respect to each other in the same plane. In an alternative arrangement for a part of their length above the pivot point the second ends of the elongate members are displaced with respect to each other, and at least one of the second ends with respect to the plane of movement of the eating implement, sufficiently to enable the second ends to cross over. The ability for the second ends of the elongate members to cross-over means that the theoretical separation that can be achieved is significantly increased.

The present invention provides an implement for the consumption of food that can be operated easily by a person single handedly enabling food to be lifted for eating and if necessary returned to the plate and released so that another piece of food can be lifted for consumption. In addition the implement can be easily and simply maintained and cleaned.

It is envisaged that the present invention will use conventional chopsticks as the elongate members, and provide a way of modifying said chopsticks and or their usage to suit circumstances and the user. In one embodiment of the present invention the elongate members are pivotable connected about a common fulcrum.

In an alternative arrangement one or both of the elongate members are pivotable mounted with respect to a common member, for example, a plate member, to which they are the mounted. The plate member may comprise a pair of opposing plates arranged so as to sandwich the elongate members therebetween. Alternatively, the plate member may be a single plate member.

In a further alternative arrangement one of the elongate members is fixed in position, for example, with regard to the plate, and the other elongate members is freely pivotable to provide the implement with the necessary freedom of movement.

In one embodiment either or both elongate members have one or more tooth formations in the vicinity of the first end thereof. One elongate member may have a groove or slot for reception of the other elongate member so as to ensure the elongate members are correctly aligned in the storage position.

In another alternative arrangement of the present invention the elongate members are located in a pivot block that allows the elongate members to be pivoted with respect to each other. In this arrangement the elongate members may be push fit into respective passages provided in the pivot block to secure them in the pivot block.

In one arrangement of the pivot block one of the elongate members is fixed in orientation with regard to the pivot block and the second member is freely pivotable with regard to the block. The pivot block of this arrangement comprises a first passage for location with regard to the elongate member that generally conforms to the elongate member to fixedly secure the elongate in an orientation with regard to the pivot block and a second passage which is of a slot like configuration that allows an elongate member located therein to pivot freely with regard to the pivot block and therefore the fixed elongate member.

In an alternative arrangement the pivot block comprises two block members that are pivoted with respect to each other about a common fulcrum with the elongate member being located in a passage provided in a respective block member.

In this arrangement of the pivot block, the block members may comprise an end section for location and holding of a respective elongate member with an extending tongue having means for mounting of the pivot point. Further, the tongues may be dimensioned so that they do not protrude above the end section.

The pivot block may be of solid or hollow construction.

The fulcrum may be formed using a bolt or stud or alternatively a press fit arrangement.

In one arrangement of the present invention the means to urge comprises an elastically deformable member or members that are deformed, for example, stretched, by pressure applied during operation, which pressure is stored and acts to urge the implement back to its storing position.

The elastically deformable member is preferably a band that is located about the elongate members at a position between the pivot point and the first ends of the members.

The advantage of using a band is that the position of the band can be easily adjusted along the length of the elongate members. As will be well appreciated the position of the band on the elongate members is critical to the pressure that will be applied by the first ends of the elongate members to grip and lift food. Some foods are more delicate and fragile than others and therefore need to be handled delicately. If a meal is to include such food then it is important that the implement does not apply a pressure to the food that would harm or damage the food and the user enjoyment of such food.

Further it is also possible to adjust the pressure applied to gripped food during a meal so that the correct grip is applied, if required. One or more notches may be provided along the length of the or each elongate member to provide predetermined positions for location of the band.

A retaining formation may be formed for retention of the band relative to one or both elongate members. Such a formation may take the form of an eye through which the band passes. The recess or notch in one elongate member may be located against a correspondingly shaped formation in the plate so as to trap the band therebetween.

In an alternative arrangement of the present invention the means to urge comprises a spring located in a passage provided in a pivot block, which spring is compressed when the eating implement is opened by the movement of the elongate members, storing energy which acts to urge urges the implement back to the closed position.

In a further arrangement the means to urge comprises a resilient member formed from a resilient material such as aluminium, steel or a suitable plastic based material. The resilient member is formed from a resilient material formed into a prefixed shape and which includes means to accommodate the elongate members wherein as pressure is applied to operate the implement the resilient member is deformed, which deformation induces a restorative force in the resilient member which acts to urge the member back to its original shape.

The elongate members may be provided with means at the first ends to help located and secure the members with respect to each other. This may be a simply groove and tongue type arrangement in which one member or a part of said member locates into a groove or indentation provided on the other member.

The invention may also include means to retain the means to urge on the implement. Where the means to urge is a band this may simply comprise a strap to hold the band in place.

Eating implements made in accordance with the present invention can be made so that they are easily dismantled to enable cleaning and maintenance. However it is envisaged that a sheath may be provided to cover the elongate members during eating. The sheath may then be disposed or washed for reuse.

BRIEF DESCRIPTION OF THE DRAWINGS

The invention will now be described by way of example with reference to the accompanying drawings in which.

DETAILED DESCRIPTION

Figure 1:
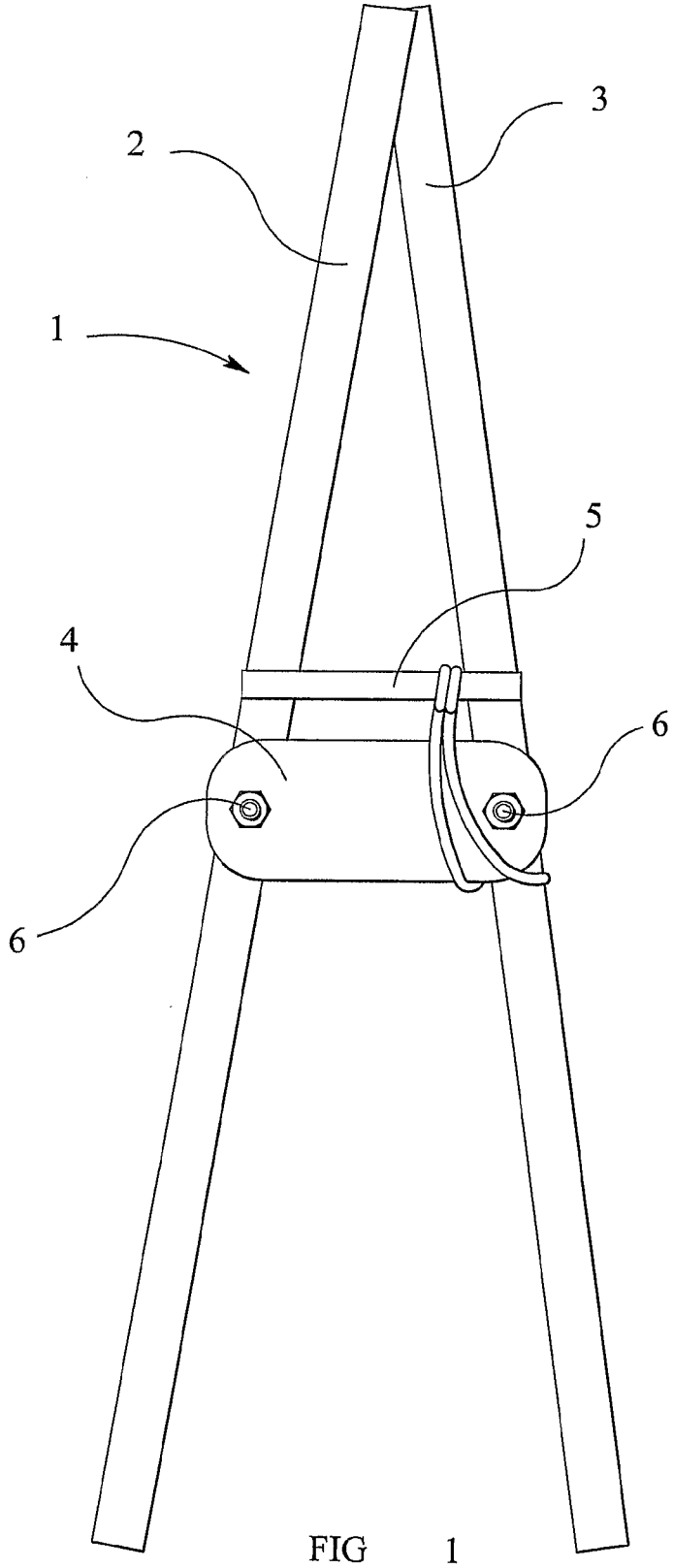
FIG. 1 shows a first embodiment of an eating implement made in accordance with the present invention.
Figure 1A:
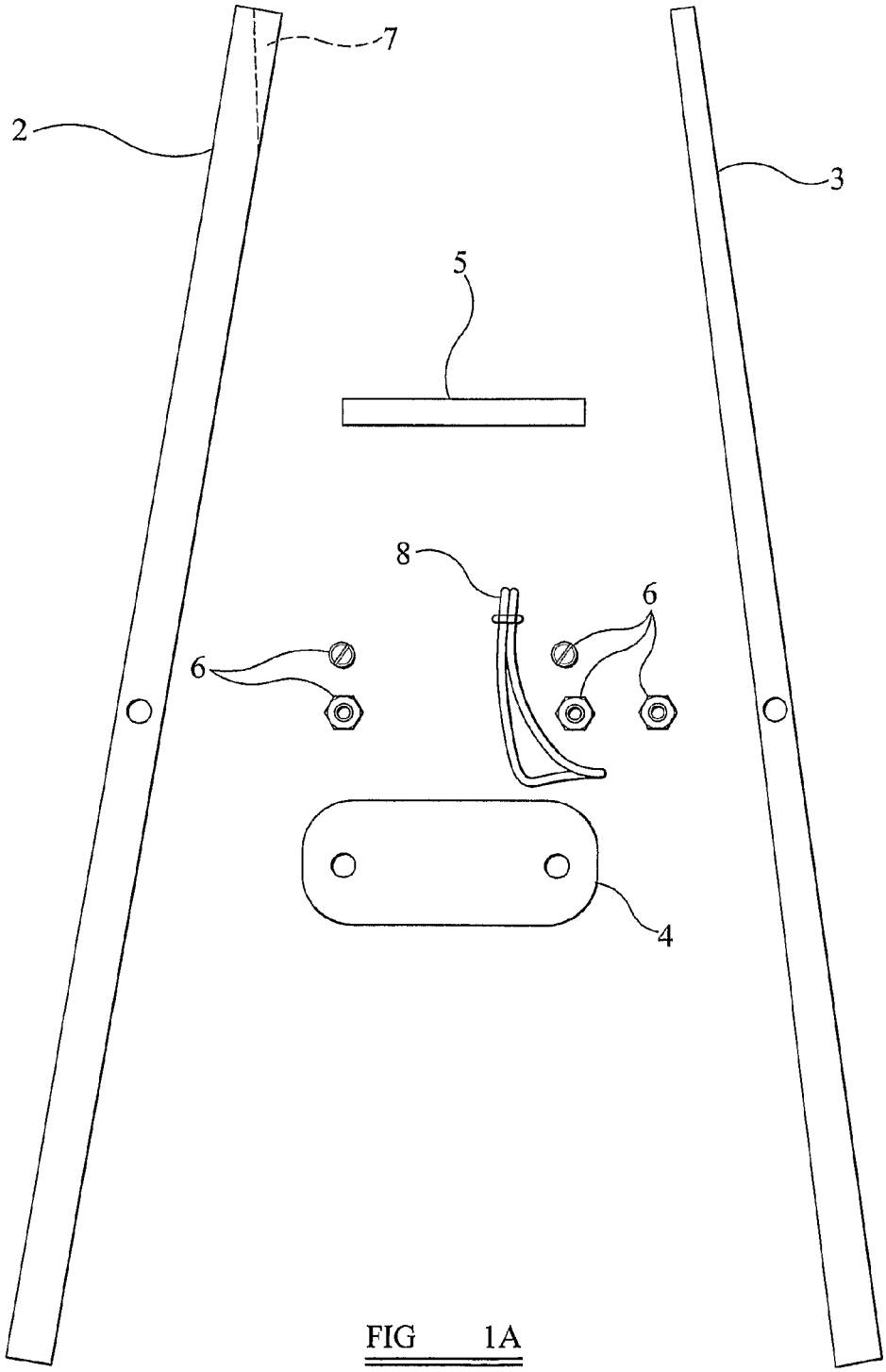
FIG. 1A shows an exploded view of the component parts of the eating implement shown in FIG. 1 of the drawings.

Referring to FIGS. 1 and 1A of the drawings a first embodiment of an eating implement 1 made in accordance with the invention will now be described in detail.

The eating implement of the invention is in effect an adapted form of sticks that has all the working formed into a single integrated implement. This enables the eating implement 1 to be used easily and does not require the skill, agility and dexterity that is normally associated with using chopsticks. The Applicant has coined the name DRADON-STICKS™ by way of reference to articles according to the present invention.

There are several schools of thought as to which type of eating implement or implements are best and easiest to use. It appears to be one of the areas in society where there is a cultural divide with each culture using the implement or implements which have traditional been used in their culture. However, having said this there is a large element in all society that is willing to experiment with eating different types of food, such as Chinese, Indian, Arabic etc and this group has traditionally also tried to use the eating elements traditional used with the type of food they are eating. In other words they are willing to experiment.

A number of embodiments of the invention are described below, for which the elongate members may be formed of a wood, a plastic or else a metal material such as, for example, aluminium. The choice of material type is dependent on whether the articles are intended to be disposable or else cleaned and repeatably used. Plastic materials offer a number of benefits for manufacturing since features can be built into the design simply by a moulding process such as injection moulding. However other materials are not to be excluded since they may offer suitable material properties for general and/or bespoke uses of the product.

The eating implement 1 of the present invention as shown in FIG. 1 comprises:

two elongate members 2, 3;

a plate member 4;

an elastically deformable member 5; and means to retain the deformable member 5.

The elongate member 2 is provided with an indentation/groove 7 in one end thereof into which the end of the other elongate member 3 can be located. In the embodiment shown in the drawings a simple groove arrangement is shown but as will be appreciated there are other ways of locating the two elongate members with respect to each other, for example a tongue and groove arrangement, side by side halves etc.

When assembled to form the eating implement each of the elongate members 2, 3 is attached to a respective end of the plate member 4. Each of the elongate members is attached by a screw fitting 6 that can be tightened to clamp and hold the elongate members 2, 3 in place with respect to the plate member 4. The tightness of this fitting will determine the ease with which the elongate members 2, 3 may be pivoted. A lock arrangement nut may be used to prevent loosening of the fitting and the problems this may cause.

In the example shown in the drawings the fitting is made via a hole drilled in the body of the elongate member 2, 3, with a screw being passed through said hole and a corresponding hole in the plate member 4. This as will be appreciated reduces the strength and resilience of the elongate member. Where the elongate members 2, 3 are formed from a suitable material the area in the vicinity of the fitting maybe thickened or a platform formed to enable the fitting of the elongate member to the plate member 4.

One of the elongate members, for example elongate member 2, is tightly secured to the plate member 4 so that it is effectively clamped to the plate member 4 and the other elongate member 3 is not so tightly held so that it may pivot about it's fixing with respect to the plate member 4. It is not important which elongate member is tightly held and which pivots. The invention will work equally well in either configuration. It is preferred that the elongate member carrying the indentation is the elongate member that is tightly clamped to the plate member 4.

The elastically deformable member 5 is preferably a stronger elastic band and in the assembled eating implement this band is located about the elongate members 2, 3 at a position above the plate member 4. The elastically deformable member 5 acts against the elongate member 2, 3 forcing them towards each other so that they abut each other at one end. Therefore in the rest position elongate member 3 will rest in the groove 7 in the other elongate member 2 whilst the other ends of the elongate members 2, 3 will be spaced apart.

The implement is operated via pressure applied to the spaced apart ends of the elongate members and the other ends are used to grip and manipulate food.

A retaining strap 8 is secured to or about the plate member 4 and the elastically deformable member to prevent said member from being lost should it be dislodged from the eating implement.

In use pressure is applied to the spaced apart ends of the device and this acts against the pressure applied by the elastically deformable member 5. The elongate member 3 is caused to pivot about it's fixing 6 and with respect to the other elongate member 2 so displacing the end of the elongate member 2 located in the groove 7 and separating these ends of the elongate members 2, 3.

The implement is then located about the food to be gripped and lifted, and the pressure applied by the user released. Under the pressure applied by the elastically deformable member 5 the elongate members 2, 3 are moved back towards their normal position at rest closing about the food so that the food is gripped. The user can then lift the food for consumption.

The pressure applied by the implement can be adjusted by altering the position of the elastically deformable member on the elongate members 2, 3. The altering of the pressure applied is in accordance with the general rule and lever principle. Therefore the pressure applied in eating a meal can be adjusted to suit the particular meal, for example, if there is a delicate and fragile food items being consumed then the pressure applied can moved so that it is a very light pressure. However this may not be sufficient for lifting heavier items, and in that case the pressure applied would be increased.

It is not being suggested that the pressure applied is adjusted during the meal but it is possible, and it is recommended that the correct level of grip be set at the start of the meal to suit the particular requirements.

Pieces of food that are too large to fit in the eating implement may be speared using the elongate member 2 or 3 when in the open position. The eating implement may then be closed to enhance the grip on the food.

In a preferred embodiment the elongate members are formed from a natural material, such as bamboo, wood, but alternative may be formed from a synthetic material, such as a plastic or from a metal or metal alloy.

Figure 2:
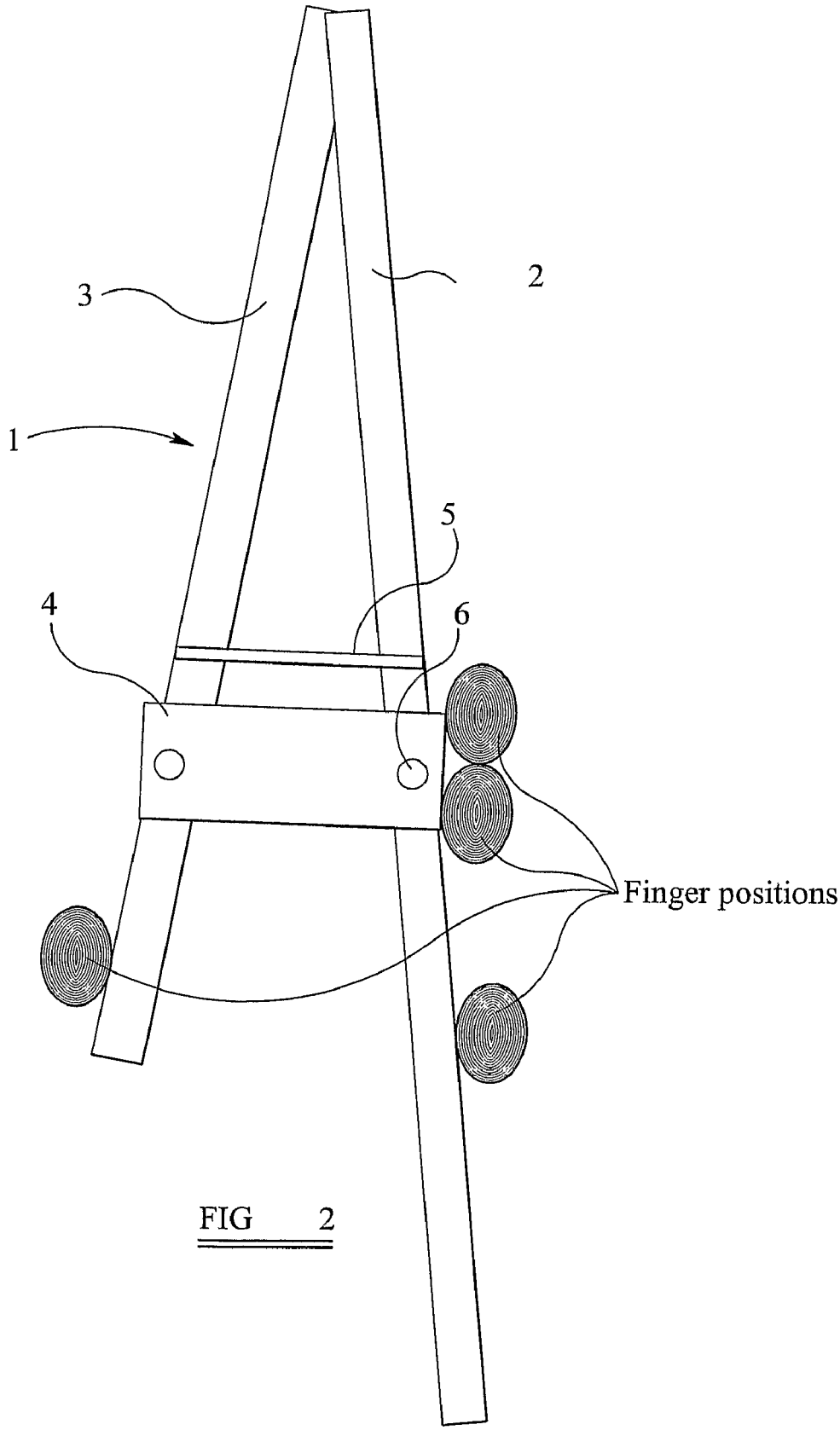
FIGS. 2, 2A & 2B show operation of an aspect of the present invention and an alternative arrangement of the present invention.

Now referring to FIG. 2 of the present invention there is illustrated an aspect of the present invention and also an adaptation of the present invention. As discussed above there are certain factors that come into consideration when designing and sizing the eating implement. The eating implement 1 illustrated in FIG. 2 of the drawings is similar in design and operational consideration to that shown in FIG. 1 of the drawings and like numerals have been used to describe like components and the description thereof is incorporated here by way of reference.

The difference between the eating implement shown here and that described above relates to the relative lengths of the elongate members 2, 3. In the embodiment described with respect to FIG. 1 the elongate members 2, 3 where of substantially equal length. In the present example the elongate member 2 is longer than the elongate member 3. This allows the separation at the first end of the elongate members to be increased without material increase in the size of the implement and so increasing the capacity (size wise) of the eating implement to lift.

Figure 2A:
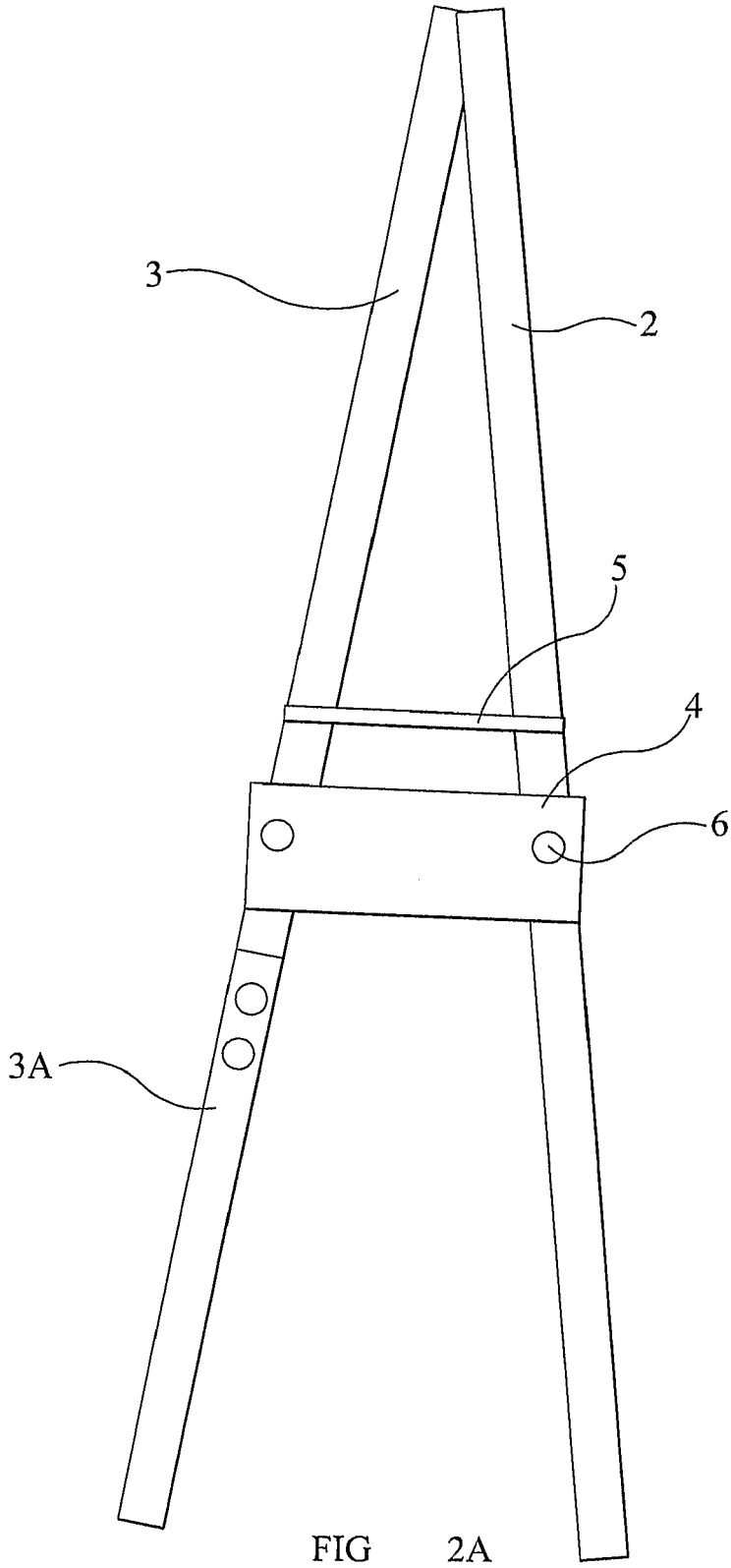
Figure 2B:
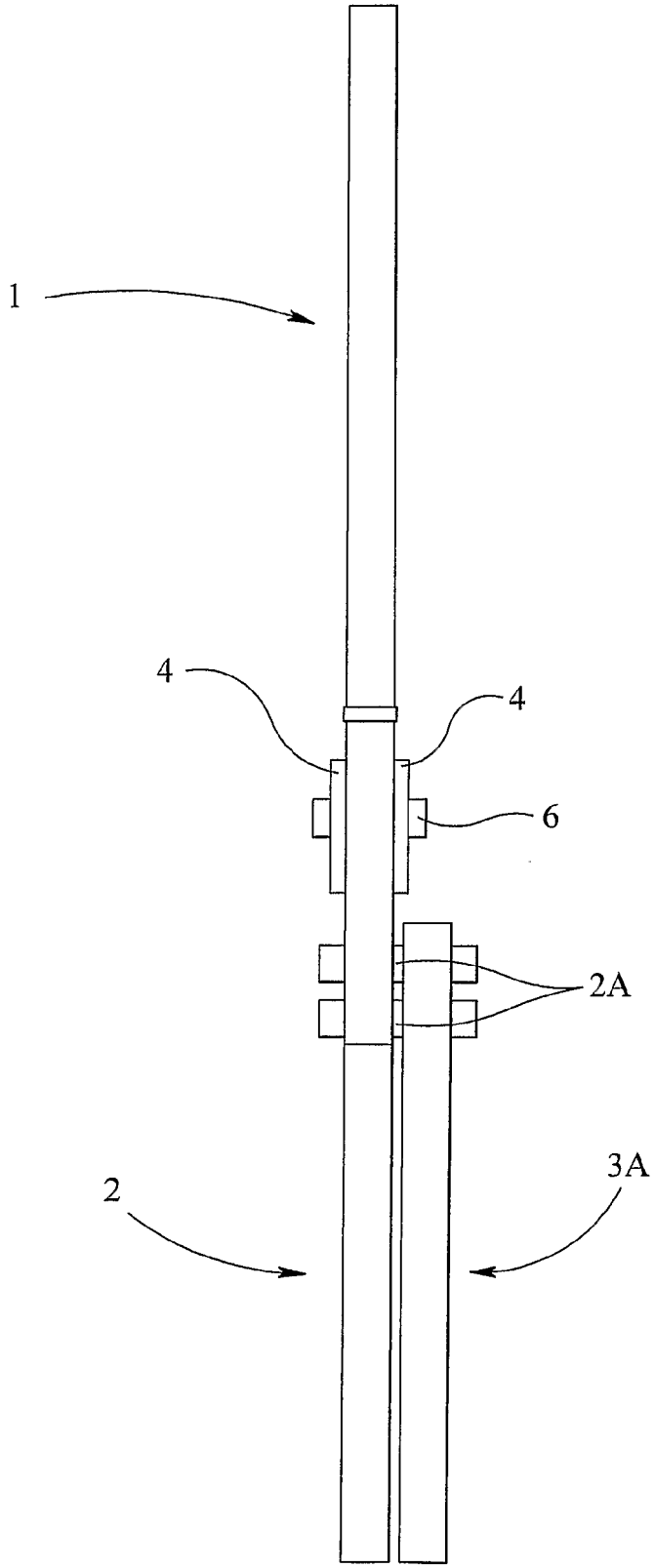

Now referring to FIGS. 2A and 2B this principle has been taken further and in this case the elongate member 3 has been returned to its original length, or substantially so, by fixing of a length 3A to the elongate member 3 via screw fixings. Washers 2A may be used to further lift the added length away from the elongate member 3.

In adding the added length 3A in this manner the added length has been moved out of the plane of movement of the remaining components of the elongate members. Therefore, in operation the added length 3A will not interfere with the elongate member 2 and the added separation in the first end is retained.

Figure 3A:
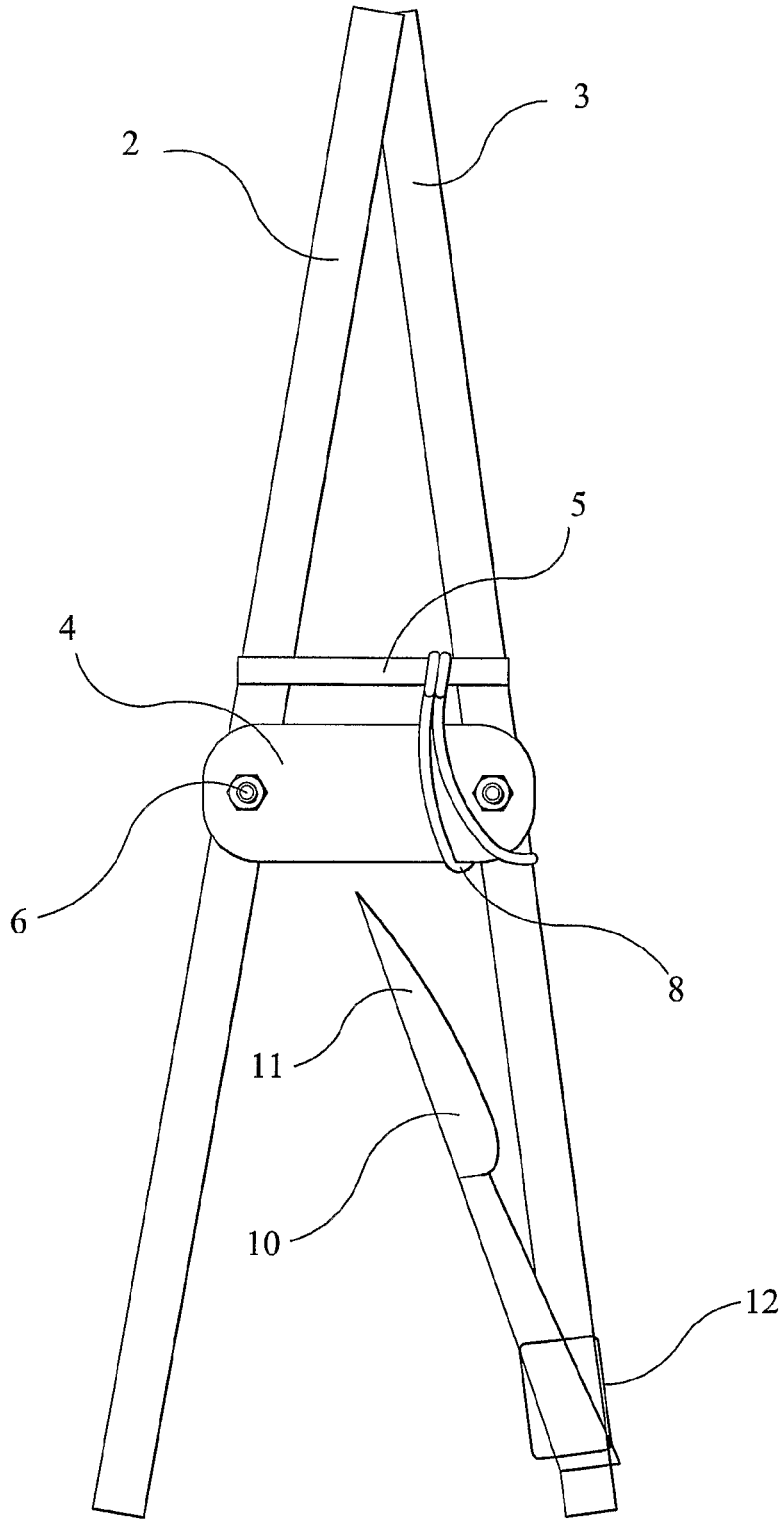
FIGS. 3*a* and 3*b* show an adaptation of the eating implement shown in FIG. 1 of the drawings.
Figure 3B:
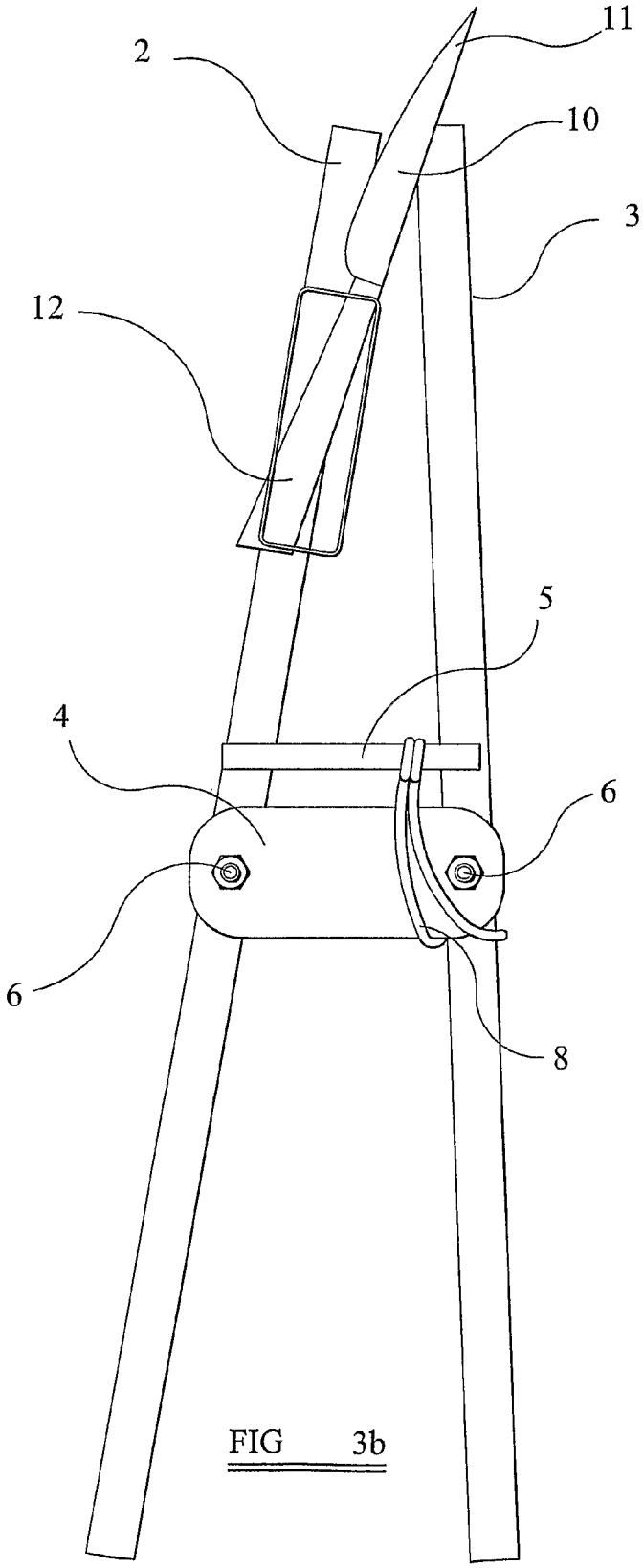

Now referring to FIGS. 3*a* and 3*b* of the drawings there is shown an adaptation of the eating implement described above. The same numbers have been used to describe like components and the description thereof is incorporated here by way of reference. The implement shown here differs from the implement described above only in that there is provided therewith a spoon implement 10.

The spoon implement comprises a plastic or metal spoon 11 having a sleeve like attachment means 12. In the storage position the sleeve like attachment means 12 can be used to secure the spoon 10 to one of the spaced apart ends of the elongate members 2, 3.

When deployed for use the sleeve like attachment means 12 is slid over the end of the elongate member 2 having the groove 7 with the back of the spoon facing outward and clear of the end of the elongate member 2. In this position it is useable for holding of amounts of smaller foods, for example, Bombay Mix, Nuts etc.

In all other aspects the operation of the eating implement is identical with that described above.

Alternatively, the spoon may be any other suitable implement such as a fork or light knife.

Figure 4:
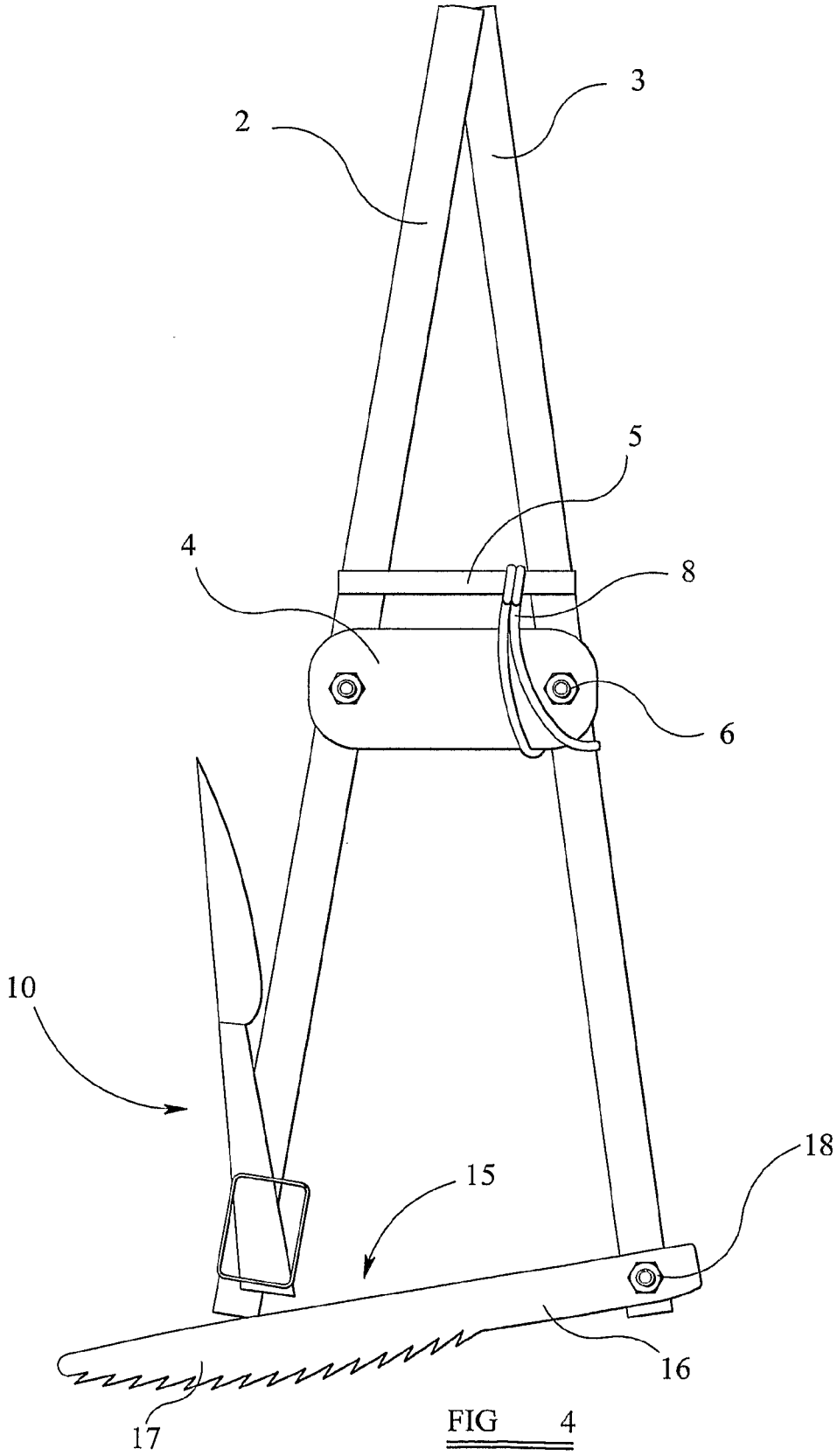
FIG. 4 shows a further adaptation of the eating implement shown in FIG. 1 of the drawings.

Now referring to FIG. 4 of the drawings there is shown a further adaptation of the eating implement as shown in FIGS. 1 and 1A. In this adaptation the eating implement 1 is similar to that described with reference to FIGS. 1 and 1A of the drawings and like numerals have been used to describe like components and the description thereof is incorporated here by way of reference. As with the adaptation described with reference to FIGS. 3*a* and 3*b* of the drawings a spoon 10 may be supplied.

However the primary difference with this particular adaptation is the supply and fitting of a knife blade 15 on the spaced apart end of the elongate member 3.

The knife blade 15 may be formed from plastic, aluminium or metal and comprises a shank end 16 with means to enable the knife blade 15 to be pivotally mounted to a second member such as the elongate member 3, and at the end remote from the shank end 16 a cutting edge 17 on the lower edge of the blade.

When mounted to the eating implement 1 the shank portion 16 of the knife blade 15 is pivotally mounted via a screw mounting 18 to the spaced apart end of the elongate member 3. Further a groove is cut in the spaced apart end of the other elongate member 2 so that when the knife blade 15 is deployed for use the upper edge of the blade remote from the shank end slots into the groove to hold the knife blade steady during use.

Figure 5:
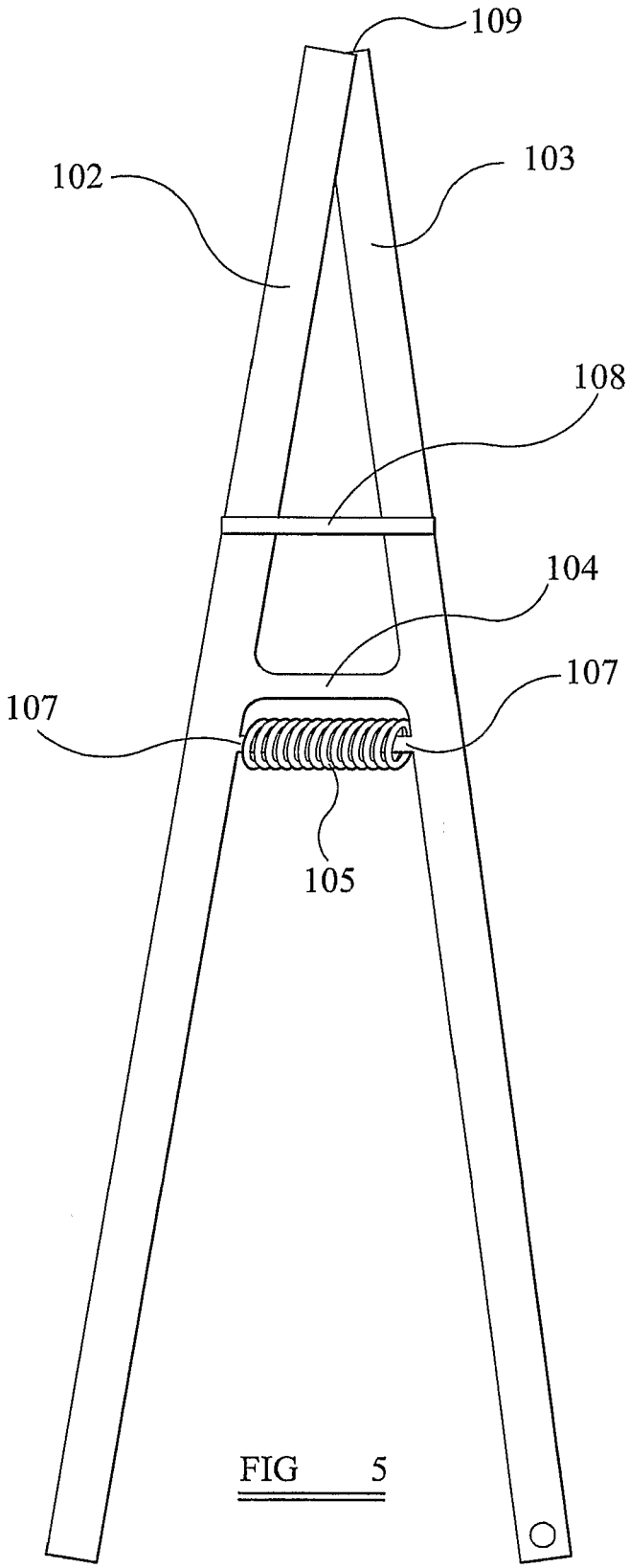
FIG. 5 shows an alternative eating implement made in accordance with the present invention.

Now referring to FIG. 5 of the drawings there is shown an alternative arrangement of eating implement. The eating implement will be described in the normal position when no externally generated pressure is being applied to separate the elongate members.

In this embodiment the eating implement is formed from a moldable material such as plastics and which eating implement comprises:

- a pair of elongate members 102, 103 that at one end are in contact with each and at the other end are spaced apart;
- a bridge member 104 interconnecting the two elongate members at approximately one third of their length;
- a spring member 105 mounted near to the bridge member 104 towards the spaced apart ends via lugs 107 provided on the elongate members 102,103 and
- an elastically deformable member 108 is also provided for location about the elongate members 102,103 at a position above the bridge member 104 towards the contacting ends of the elongate members.

As in the previous embodiment of the invention at the contacting ends of the elongate members the elongate member 103 is provided with a groove 109 to accommodate the end of the elongate member 102.

The operation of the eating implement is the same as with the eating implement 1 described with reference to FIGS. 1 and 1A of the drawings and that description is incorporated here by way of reference. Whilst the operation of the implement may be the same the generation of the relevant forces for the implement are not the same.

In this example as the spaced apart end of the elongate members are squeezed together the material of the eating implement is deformed with a turning force is generated in the bridge member 104. Also when the elongate members 102, 103 have been opened sufficiently the spring member 105 will be compressed.

Both of these forces are in addition to the force that will have been generated by the deformation of the elastically deformable member 108. All of these forces will act to return the elongate members 102,103 to their normal position when the spaced apart ends of the elongate members are released from the operating pressure that has been applied by a user.

Figure 6:
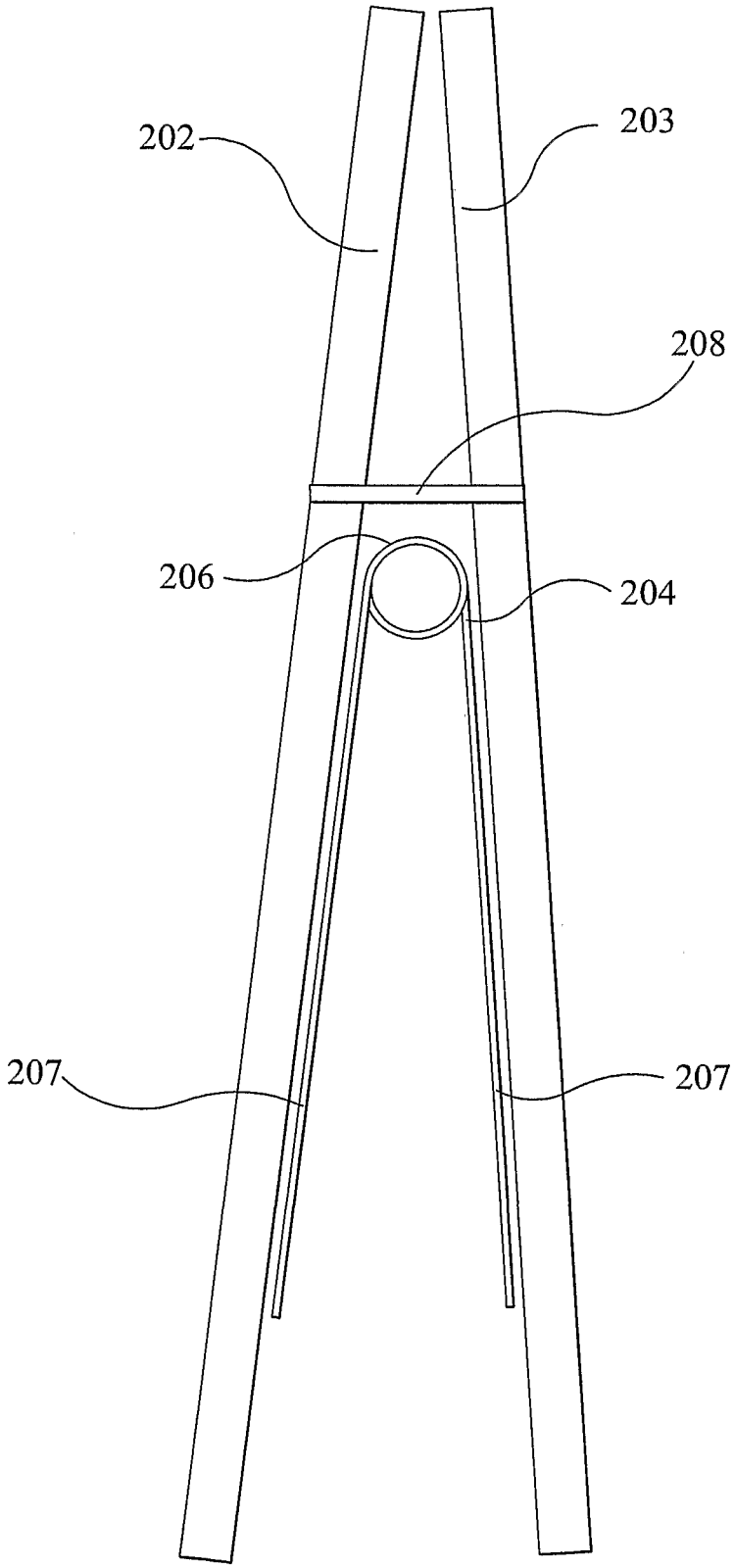
FIG. 6 shows another alternative eating implement made in accordance with the present invention.

Now referring to FIG. 6 of the drawings there is shown a further embodiment of the present invention. In this embodiment of the invention the eating implement comprises:

- two elongate member 202, 203 deployed with ends that are in contact with one another and a spaced apart end;
- a spring member 204 located between said elongate members; and
- an elastically deformable member 208.

The spring member 204 has a central turn section 206 with two extending arms 207. Each of the arms 207 is secured to a respective elongate member 202, 203. The central turn section 206 of the spring member 204 will act as the fulcrum, pivot point of the elongate members as pressure is applied to operate the implement.

This embodiment of the eating implement is operated in the same manner as with the other embodiments of the implements and the description thereof is incorporated here by reference.

Figure 7:
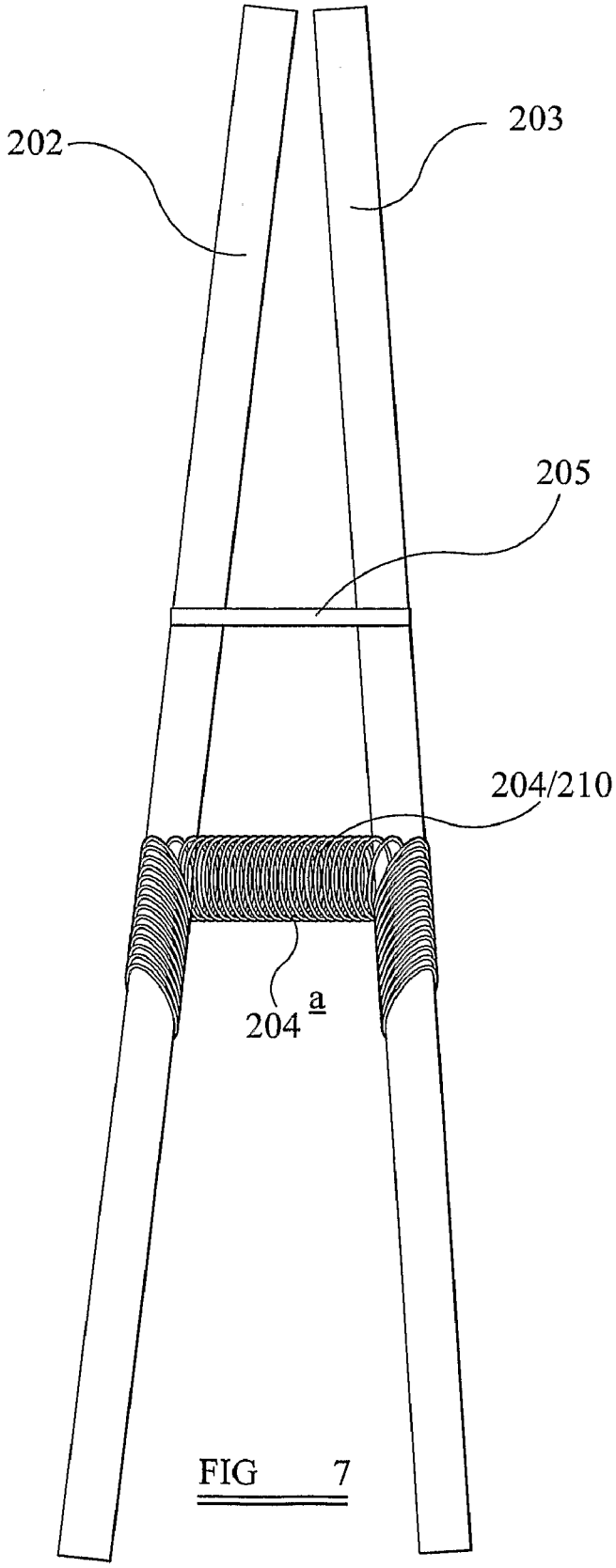
FIG. 7 shows yet another alternative eating implement made in accordance with the present invention.

Now turning to FIG. 7 of the drawings there is shown a yet further embodiment of the present invention. This embodiment of the invention is similar to that of FIG. 6 of the drawings and the description thereof is incorporated herein by reference. Like numbers have been used to describe like components. The difference between the two embodiments is in the spring member. In this embodiment the spring member comprises a compression spring 210 which is deformed so that the elongate members can be passed along a section of the spring and then passed out through the sides of the spring. The section of the spring 204*a* between the points where the elongate members 202, 203 pass through the coils of the spring 204*a* forms a bridge between the two elongate members 202, 203.

The operation of the implement is the same as with the above-mentioned embodiments and that description is incorporated here by way of reference.

Figure 8:
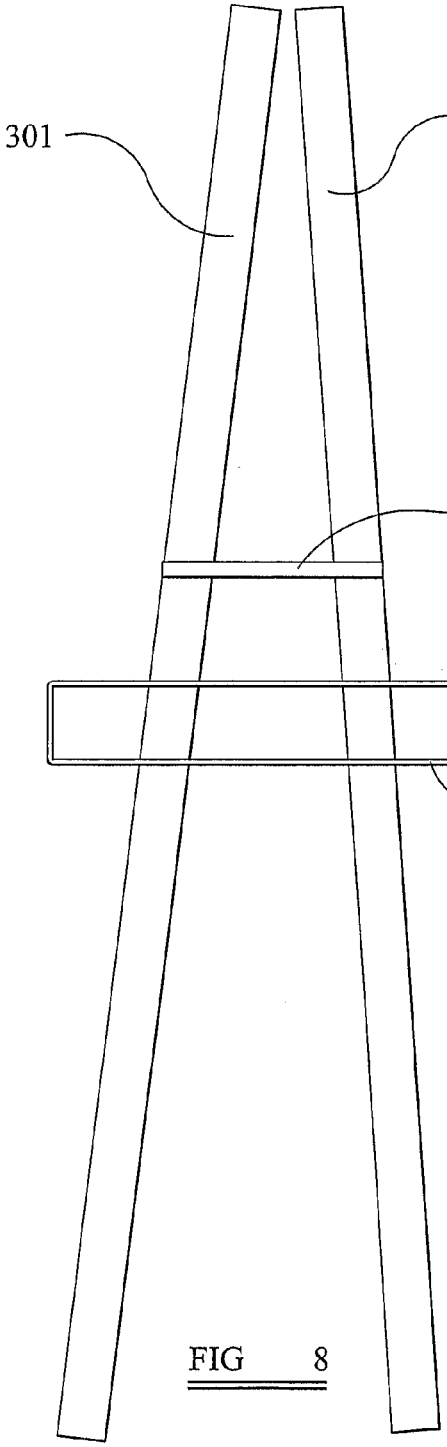
FIG. 8 shows a further alternative eating implement made in accordance with the present invention.

Now turning to FIG. 8 of the drawings there is shown a further example of the present invention. In this example of the invention the eating implement 300 comprises:

two elongate members 301, 302;

a pivot block 303; and an elastically deformable member 304.

The elongate members 301, 302 may be formed with a groove and location facility as described with regard to the earlier embodiments of the invention. Further, the elongate members 301,302 may be provided with suitable location means. In this example a notch 302*a* is provided in the elongate member 302, and a pair of notches 301*a* are provided in the elongate member 301.

Figure 8A:
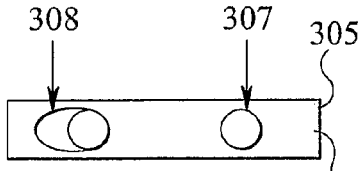
FIGS. 8*a* to 8C show different views of the pivot block shown in FIG. 8 of the drawings.
Figure 8B:
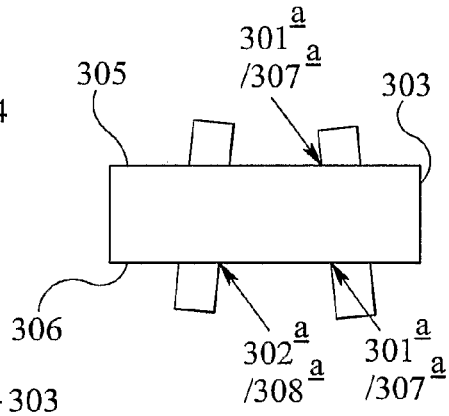
Figure 8C:
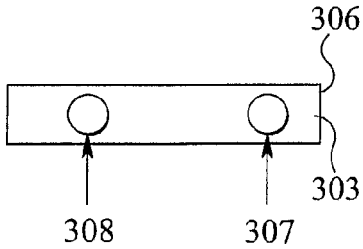

The pivot block 303 which is shown in greater detail in FIGS. 8A to 8C, comprises a solid block of a rectangular construction having an upper edge surface 305 and a lower edge surface 306. There are two enclosed passages 307,308 running form the upper edge 305 to the lower edge 306 into which respective elongate members can be located.

These passages 307,308 are set at a slight angle to the axis of the pivot block 303 so that for each passage, the passage at the upper edge 305 is closer to a respective side edge of the pivot block 303 than it is for the lower edge 306. The passage 307 is provided with protrusion 307*a* at each opening of the passage and the passage is provided with a protrusion 308*a* in the opening at the lower edge 306.

In the example shown in these Figures the passage 307 is of substantially constant diameter while the passage 308 is of tapered section moving from a slot at the upper edge 305 to a circular opening at the bottom edge at the lower edge 306 of the pivot block 303. The passage 307 grips and holds the elongate member 301 inserted therein in a fixed position with regard to the pivot block 303 whereas while the passage 308 also holds the inserted elongate member 302 in the pivot block it allows the elongate member to pivot with respect to the pivot block 303 and the other elongate member 301.

Each of the entrances of the passages at the respective upper 305 and lower 306 edges may be chamfered.

The elastically deformable member 304 is located about the end of the elongate members 301,302 at a point above the pivot block 303.

When assembled for use Chopsticks are inserted into each of the passages 307,308 in the pivot block 303 until the protrusions at the openings engage in the notches provided on the chopsticks. Further the elastically deformable member 304 is located about the appropriate ends of the chopsticks.

The assembled implement is now ready for use and its operation is broadly similar to that with the implements described above. However in this example the pivot of the elongate member is enhanced It should be noted that with this embodiment of the invention it is important that each of the passages in the pivot block is correctly sized. If the chopstick is too small it will simple move around in the pivot block and the pivot block will simply fall to the ground. It is important that the fit of the chopstick in the pivot block is tight enough to hold the pivot block in place but not so tight to prevent operation of the chopsticks or removal of the chopstick with the application of a judicious force. Further the quality of the fit in the passage may be adjusted so that a chopstick located in a particular passage can be moved more easily than the chopstick in the other passage.

With this arrangement of the present invention the pivot block 303 will have to be created and sized to suit a particular type or make of chopsticks.

The pivot block 303 can be made from any suitable material such as wood or moulded plastic. In addition the passages may be formed with either straight sides or shaped sides to assist and guide the movement of the chopstick in the passage under the application of a suitable force.

In one adaptation of the pivot block 303 principle described above one of the passages is a simple hole through top to bottom through the block and acts to grip and hold a chopstick in a fixed position and orientation. A second opening running also top to bottom of the pivot block is also provided and is more slot like in nature with the slot running along the top edge of the pivot block. The slot has an overall V shape and is sized so that it narrows in all directions as you go from top to bottom of the pivot block. A chopstick inserted into the slot will be gripped by the sides of the slot at the appropriate position while also being allowed to move sideways with respect to the pivot block along the length of the slot.

In a further variation of this pivot block arrangement the sidewalls of the slot may be shaped to enhance the pivotal movement of the chopstick in the pivot block.

Figure 9:
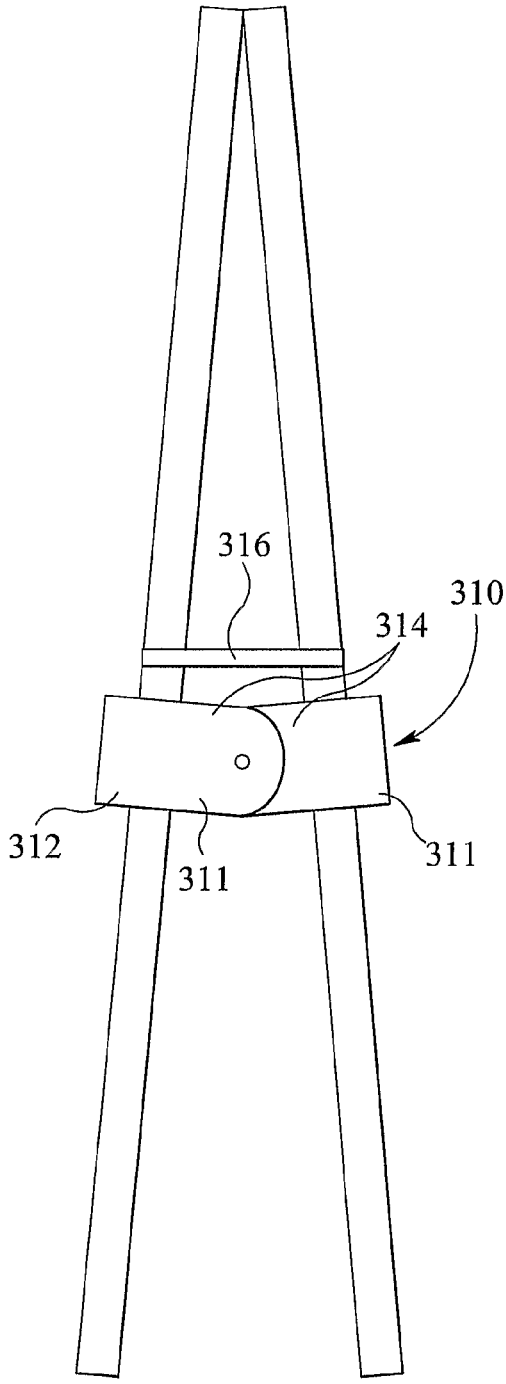
FIGS. 9, 10 & 11 show a further embodiment of the present invention.
Figure 10:
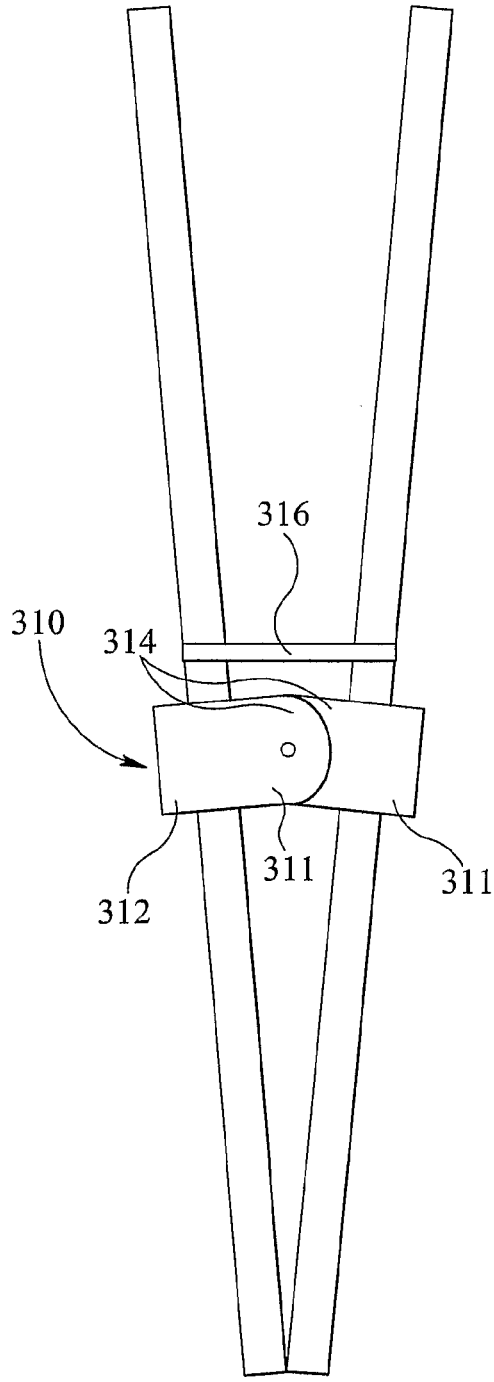
Figure 11:
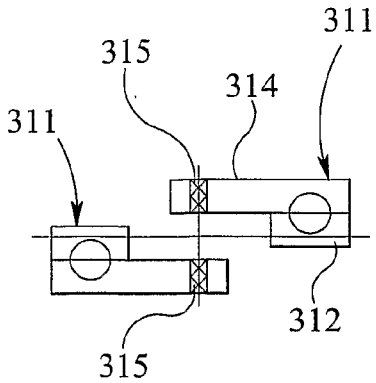

Now referring to FIGS. 9, 10 and 11 of the drawings there is shown a further embodiment of the present invention.

FIGS. 9 and 10 show the eating implement in the closed and open positions respectively. The eating implement shown is similar to that shown and described above with regard to FIGS. 1 and 1A of the drawings and like numerals have been used to describe like components, and the description thereof is incorporated here by way of reference.

In the eating implement shown here the difference is in the arrangement of the pivot. As with the eating implement described with reference to FIG. 8 of the drawings a pivot block 310 type of arrangement is used.

Now referring also to FIG. 11 of the drawings the pivot block 310 comprises two complementary components 311 each having an end section 312 and a tongue section 314 with a bore 315 provided therein. The end section is of sufficient size to allow for the provision of an opening that extends through the end section from top to bottom and is sized for the friction fitting of an elongate member such as a chopstick. The tongue section 314 extends to the side of the end section 312 and has an outer surface and a mating surface.

In use the two complementary components 311 are assembled with the mating surfaces in contact and the bores 315 aligned. A bolt is fitted through the bores 315 to provide the pivot axis of the arrangement. An elastically deformable member 316 is also provided which acts as the means to urge. The mating surfaces of the tongue sections have a smooth surface finish to enhance the movement of the two complementary members when the implement is being used.

The operation of the eating implement is broadly similar to that described above and the description thereof is incorporated herein by way of reference.

A pivoting plate arrangement may be substituted in place of the pivot block arrangement of FIGS. 9-11, wherein the plates pivot about a common axis of rotation between the sticks. A pair of plates provided for one stick may be aligned with a pair of plates for the other stick such that the opposing sets of plates have an opening therein, through which a pin or bolt can be inserted to act as a common axis or pivot for the sticks. The sticks may be attached to the plates using one or more bolts or rivets similar to the embodiment of FIG. 1, 2 or 14-16.

Furthermore, whilst the pivoting blocks of FIG. 11 are shown as having opening of size and shape sufficient to closely surround a stick, it will be appreciated that in an alternative embodiment, the openings could be enlarged to allow selective positioning of the sticks therein. The sticks can thus be positioned as required and fixed in place using, for example, a screw which is tightened so as to contact the stick.

Figure 12:
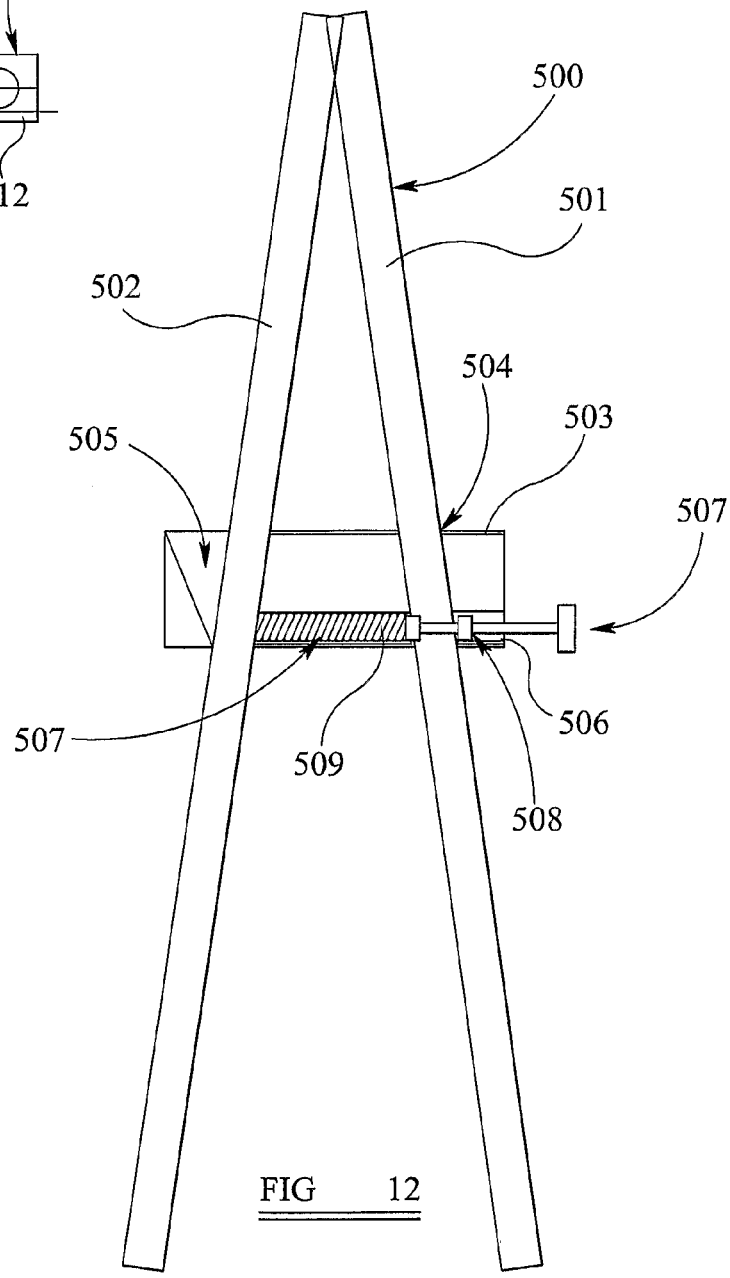
FIG. 12 shows another eating implement made in accordance with the present invention.

Now referring to FIG. 12 of the drawings there is shown a further embodiment of the present invention. This embodiment of the eating implement 500 is broadly similar to that described with respect to FIGS. 1 and 1A of the drawings.

The eating implement 500 comprises two elongate members 501, 502 mounted in a pivot block 503.

The elongate members 501, 502 of this arrangement as in the previous embodiments of the invention described are chopsticks.

The pivot block 503 includes two passages 504, 505 extending from top to bottom of the block 503. In addition there is a bore 506 extending from one side passing through the passage 504 and contacting the passage 505.

The passage 504 is sized for the interference fit of elongate member 501 so that it holds the elongate member in place with respect to the pivot block during use of the eating implement 500 but the elongate member can be easily removed for cleaning. The passage 505 has a slot like configuration and is sized so that whilst it grips an inserted elongate member 502, it will allow the elongate member 502 to pivot relative to the pivot block 503 and the other elongate member 501.

Located in the bore 506 is a spring member 507. The spring member 507 includes means 508 to anchor the spring member in the bore 506, a spring 509, and means to adjust the tension in the spring 509.

The anchor and the means to adjust the tension in the spring 509 may be included in the same unit. In this example a nut and bolt arrangement is used where a first nut sized to provide the anchor is located in the bore 506 prior to the passage 504 and a second nut is fixed to the end of the bolt so that as the bolt is rotated the bolt turns in the first nut moving the second nut relative to the bore 506.

The nut and bolt arrangement is located so that the second nut acts against the spring 509 forcing it against the elongate member 502 located in the passage 505. The location of the spring member relative to the pivot point of the elongate member 502 in the passage 505 is important to the operation of the implement. The spring 509 has to act against the elongate member 502 at a position below the pivot point in order to induce the right direction of turning force on the elongate member. The turning force needs to be in a direction that will cause the eating implement into the closed position. In addition it needs to be sufficiently below the pivot point for an efficient use of the energy in the spring member but sufficiently close to the pivot point so as not to effect the efficient opening and closing of the eating implement.

In operation the eating implement is assembled with chopsticks inserted into the passages 504, 505 so that the chopsticks are securely held in the pivot block 503 and at a similar height. The user applies pressure to the separated ends of the chopsticks so that the chopsticks pivot with respect to each other opening the implement. This movement causes the spring 509 to be deformed and energy to be stored therein.

The user places the implement so that the opened ends of the chopsticks are either side of a piece of food. The user releases the pressure being applied and under the influence of the stored energy in the spring 509, the implement closes about the food, and gripping the food. The food may then be lifted for consumption.

In contrast to the spring arrangement of FIG. 12, the solid block may be used in conjunction with the type of band 5 shown in FIGS. 1 and 2. In such an embodiment, one stick may be rigidly bolted into the solid body using two spaced bolts or rivets and the other stick may be attached to the other side of the body by a single bolt or rivet which acts as a pivot point. The body may have internal channels to accommodate the sticks or else may have opposing flange portions at either or both ends thereof for reception of a stick.

Figure 12A:
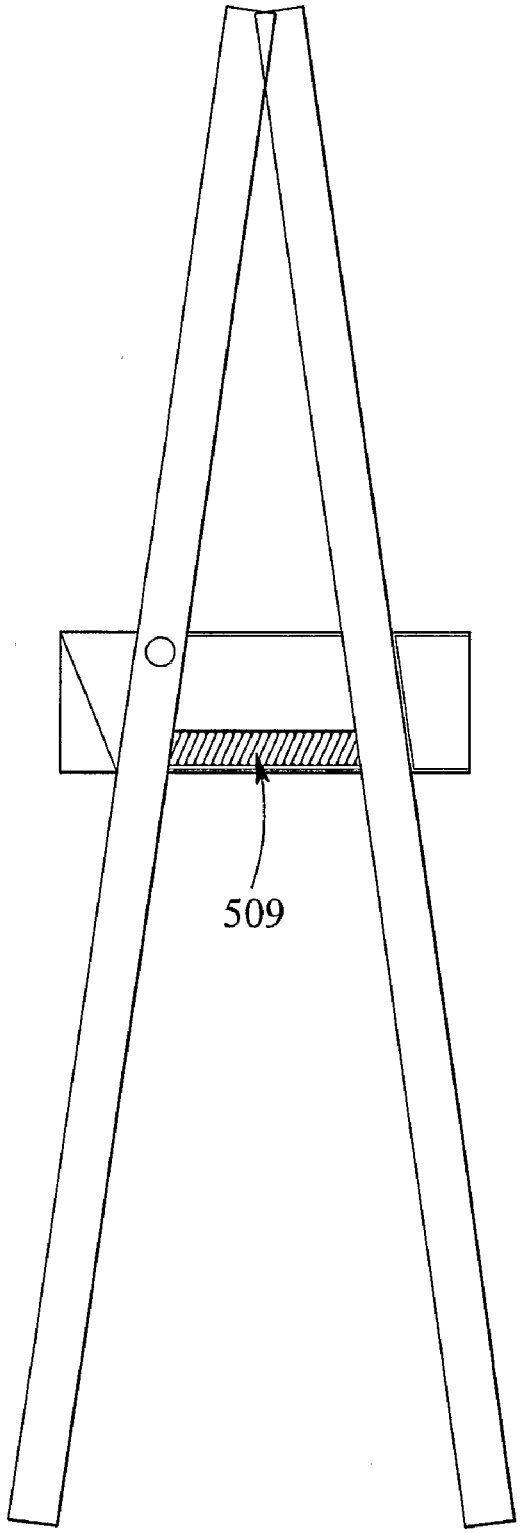
FIG. 12A shows a variation of the eating implement of FIG. 12.

Referring to FIG. 12A a simplified version of the sticks of FIG. 12 is shown in which the spring 509 is not adjustable. Instead it is set to a predetermined spring force. In all other ways the sticks are the same as those shown in FIG. 12.

Figure 13A:
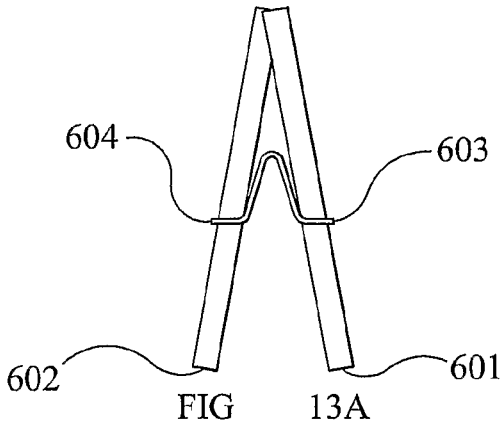
FIGS. 13A, 13B & 13 C show eating implements in accordance with the present invention that include different means to urge.
Figure 13B:
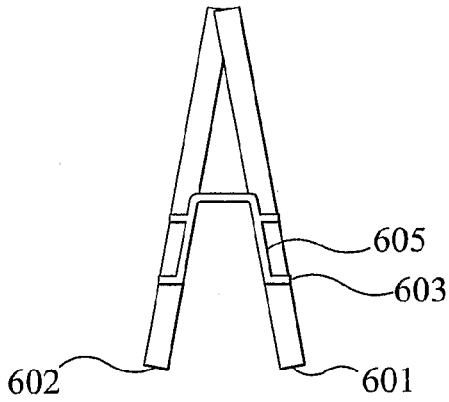
Figure 13C:
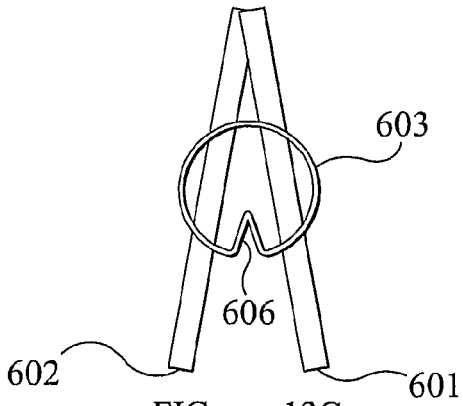

Now referring to FIGS. 13A, 13B & 13C of the drawings there is shown eating implements made in accordance with the present invention that include differing arrangements of the means to urge.

As with the embodiments of eating implements shown above the eating implement includes two elongate members 601, 602. In this example the elongate members 601,602 are moveable. The elongate members 601,602 have a first end and a second end, and when in the normal position the first ends of the elongate members are in contact with each other, and the second ends are separated.

The elongate members are located in a member 603 that holds and locates the elongate members in position for operation and use of the device. Normally the elongate members will be push fitted into holes provided in the member 603.

FIG. 13A shows a configuration in which the member 603 comprises a single concertina with flat end sections 604. The elongate members are push fitted into holes provided in the end section 604. In addition a second retention means spaced apart from the holes is also provided to ensure that the implement maintains configuration when a pressure is applied to work the implement.

FIG. 13B shows a second arrangement wherein the member 603 is U-shaped having two arms 605 each of which is attached to a respective elongate member 601,602 in at least two places.

FIG. 13C shows a third arrangement in which the member 603 is formed as a band which has an overall shape that is circular with a kink 606 to allow the member 603 to deform from the true circular shape of the majority of its circumference. Spaced around the band are two series of two holes. A series on each side of the kink 606 wherein into each series of holes there can be inserted first and second elongate members 601,602.

The basic operation of each of the above designs of eating implements is similar, and that in turn is similar to the operation as described with regard to FIGS. 1 and 1A of the drawings. With each of the arrangements as pressure is applied to open the eating implement the elongate members 601,602 pivot about a fulcrum and the first end so the elongate members are separated. In turn a twisting force is generated that deforms the member 603.

When the pressure applied to the second ends of the elongate members is released, the force stored in the member 603 exerts a pressure to move the elongate members back to the standard position with the first ends in contact.

Figure 14A:
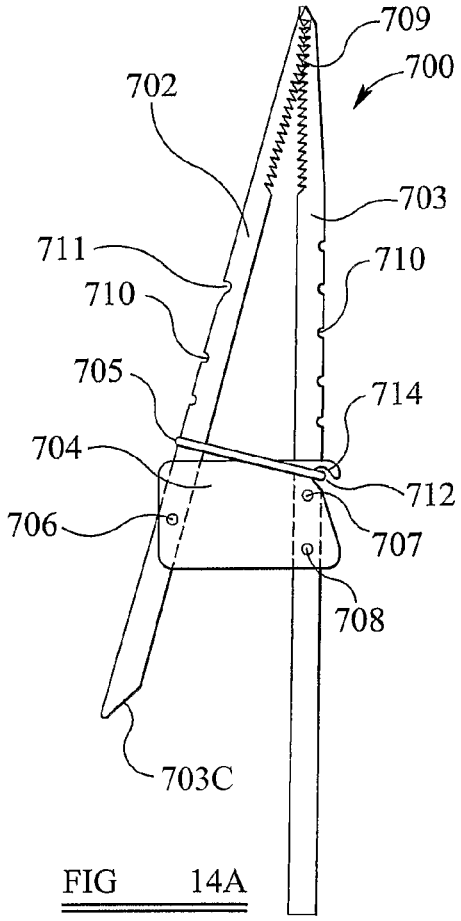
FIGS. 14A and 14B show respective plan and perspective views of an eating implement according to a further embodiment of the invention.

Turning now to FIG. 14, there is shown an implement 700 according to further working embodiment of the present invention which is in many ways preferred. The eating implement 700 comprises first 702 and second 703 elongate members; plate members 704; and, elastically deformable band 705.

Plate members 704 comprise a pair of opposing plates which are generally rectangular in plan and between which the first and second elongate members are retained by bolts 706 to 708. It has been found that the dimension of the plates which is substantially parallel to the longitudinal axis of the elongate members is of importance since it helps to retain the elongate members within the same plane. That is to say the width of the plates as shown helps maintain the correct alignment of the elongate members 702 and 703 during use and prevents the elongate members becoming skewed.

The bolts 706 to 708 may take the form of pins or rivets which pass through the plates 704 and elongate members. Member 703 is fixed between plates 704 by a pair of spaced bolts 707 and 708 such that it is rigidly held in alignment relative to the plates. Member 703 is fixed towards a first edge of the plates whereas member 702 is fixed at an opposing edge of the plates 704 by a single bolt 706. Member 702 can pivot about bolt 706 during use in a manner described above and is biased towards a closed position by band 705.

The length dimension of member 702 is shorter than that of member 703 similar to the arrangement of FIG. 2. The members are aligned at a first end of the implement which is intended for contact with food during use, such that the member 702 extends rearwardly from the plates 704 to a lesser degree than that of member 703. This allows a relatively large degree of separation at the mouth of the implement when the member 702 is pivoted about bolt 706.

Furthermore the truncated end of elongate member 702 has an angled end face 703C which is arranged obliquely to the longitudinal axis of the member. This serves to maximise the opening angle of the implement and provides an abutment face for contact with the side of elongate member 703 when the implement is in it fully open condition.

Teeth formations 709 are provided in each elongate member towards the end of the implement which is arranged for contact with food. These formations have been found to be beneficial in improving the grip on foodstuffs held by the implement.

In addition, it can be seen that the elongate elements taper towards their respective ends for contact with food during use. In particular, the elongate elements taper in width so as to form a nose section towards their respective first ends. This shape has been found to allow an improved mode of use, whereby a user can open the implement can open the members 702, 703 slide easily under food and also to stab one of the members into the foodstuff. When the opening force applied by a user is removed, the other member closes towards the stabbed member under action of the band 705 and grips against the edge of the foodstuff.

This mode of use has been found to be useful for eating layered food stuffs such as hamburgers, sandwiches and the like, or else large foodstuffs which are larger than the maximum open dimension of the implement 700.

A number of notches 710 are formed along the length of the elongate members 702 and 703 between the plates 704 and the first end of the sticks. The notches provide predetermined locations for reception of the band. Thus the notches are shaped to receive the band so as to reduce slippage of the band during use.

End notch 711 in member 702 is shaped such that it has a first edge which is arranged at a relatively shallow or acute angle relative to the longitudinal axis of member 702 and a second edge which is oriented at a greater angle relative to the first member. This shape of notch eases entry of the band into the notch from a rearward direction but provides an abutment to prevent the band easily passing forward of the notch during use. The rearmost notch 712 in member 703 may be formed in a similar manner.

Figure 14B:
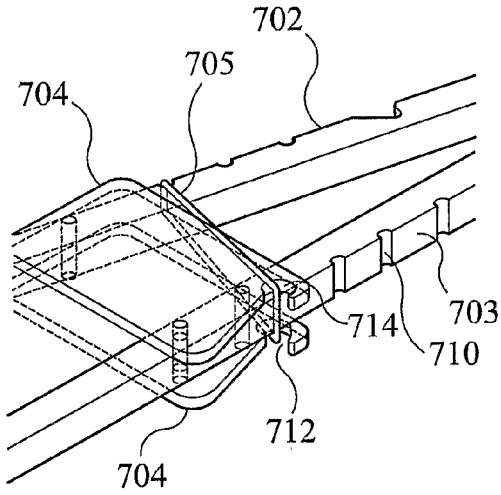

As shown in further detail in FIG. 14B, the plates 704 are shaped to provide a recess 714 in the vicinity of notch 712. The recess is angled relative to the edge of the plates and faces rearwardly, that is, away from the first end of the implement. This angled recess in conjunction with notch 712 serves to inhibit accidental movement of the band forward of the plates 704. Thus the band is partially trapped in recess 714. However the band can be manipulated by a user in a rearward direction such that it is removed from the recess 714 in the event that an alternative positioning is required.

Figure 15:
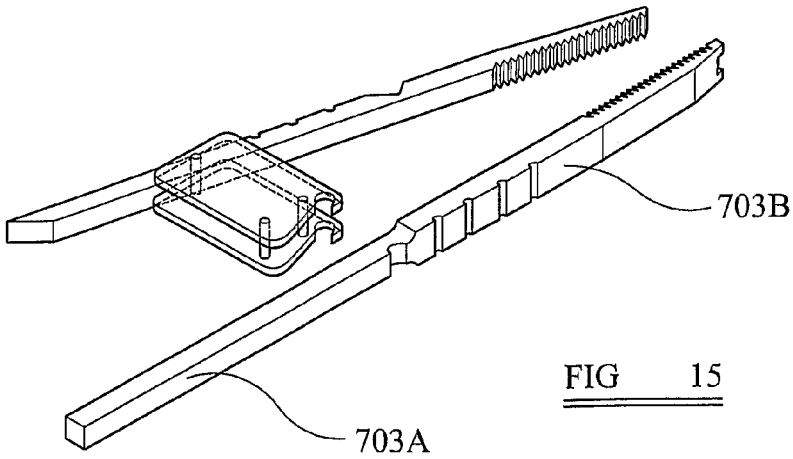
FIG. 15 shows a partially exploded perspective view of a further embodiment.

An alternative embodiment is shown in FIG. 15, which is similar to the embodiment shown in FIG. 14, save that one or more dimensions of the elongate member 703 are increased towards its first end. In this embodiment, the depth of the elongate member 703 is increased towards its first end. More particularly, the member 703 has a rearward portion 703A of a first depth and a second portion 703B, forward of the plates 704, having a second, enlarged depth.

The portion 703B has a slot or groove therein for reception of the corresponding end of the member 702. The increased depth of member 703 towards its first end provided additional grip and stability for holding larger and/or heavier foods in use.

Figure 16:
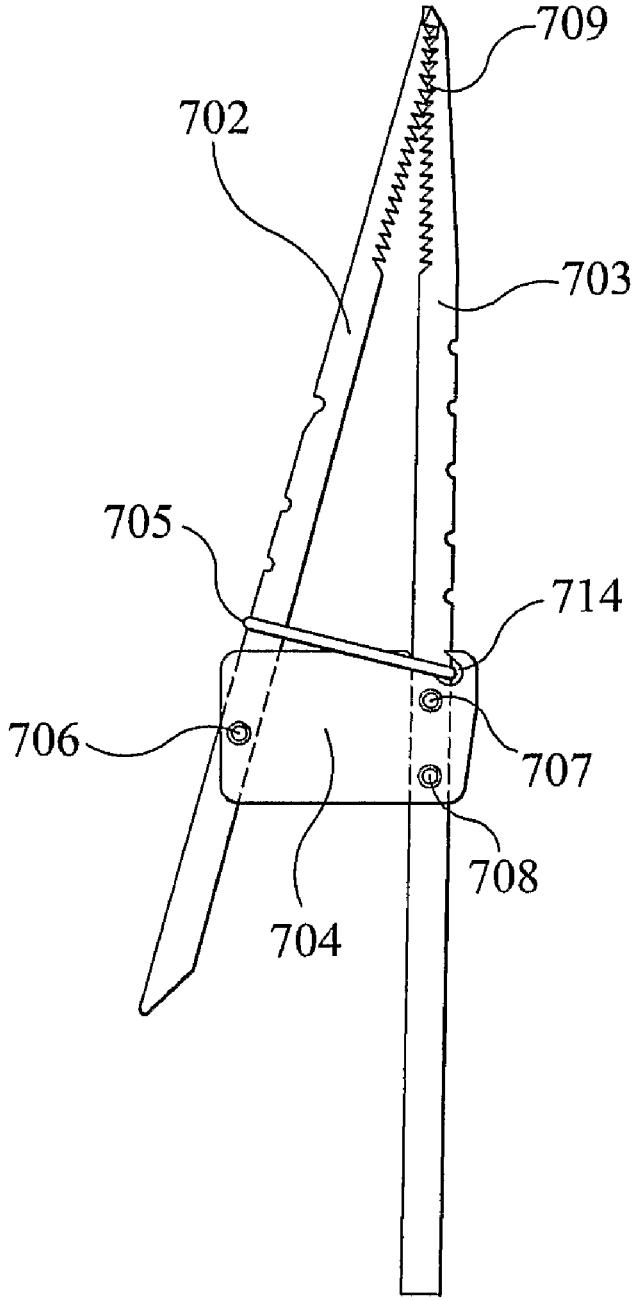
FIG. 16 shows a plan view of an eating implement according to a modified version of the embodiment of FIG. 14.

Turning now to FIG. 16, a further embodiment is shown which is similar to the embodiment of FIG. 14, save that the recess in plates 704 is shaped to oppose the notch 712 in the member. Thus when the plates 704 and member 703 are aligned as shown, the opposing notch 712 and recess 714 form a closed enclosure or eye formation in which the band 705 is retained. This prevents escape of the band from the implement without first removing plates 704.

In this embodiment the band is fixed only to member 703 and is free to move relative to member 702 so as to allow selective positioning of the band for use. Whilst this is considered to be beneficial for adjustment of the tension of the band, it is also envisaged that an alternative embodiment is possible in which the band is fixed to both members 702 and 703 by forming suitably shaped recesses 714 in each side of the plates 704.

Figure 17:
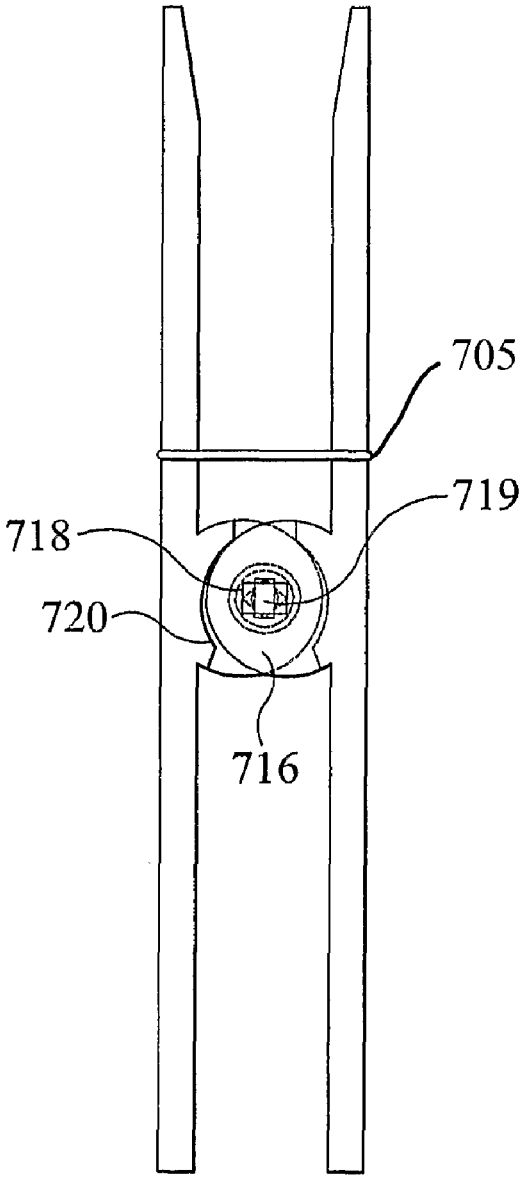
FIG. 17 shows a plan view of an eating implement according to a further embodiment.

In FIG. 17 a further embodiment is shown, which is based upon the principal of a central pivot point about which both sticks can rotate in use. Each stick comprises an ear or lobe formation 716 shaped to oppose a corresponding lobe formation 716 on the opposing stick. Each lobe formation has an aperture 718 therein, which is arranged to be located with the aperture on the opposing lobe formation 716 so as to allow a connector 719, such as, for example, a friction bolt of the type used for conventional scissors, to be passed therethrough.

Each lobe formation 716 may be provided with a corresponding groove 720 for reception of the opposing lobe 716. The groove 720 may be curved in shape so as to allow relative rotation between the lobes. The lobes 716 are preferably integrally formed with the sticks such as, for example, by a moulding process.

In the example shown, the sticks are provided with a band 705 of the type described above in order to bias the sticks to a closed position. However in an alternative embodiment, the band may be removed and the biasing force may be provided by way of a biasing member located in apertures 718. In such an embodiment, the apertures may be non-circular in profile and may have one or more straight edges. A biasing member such as a small leaf spring or else a resilient body of material may be inserted in the common opening of the apertures 718. An alternative biasing member such as a torsion spring or bolt may also be used.

Figure 18:
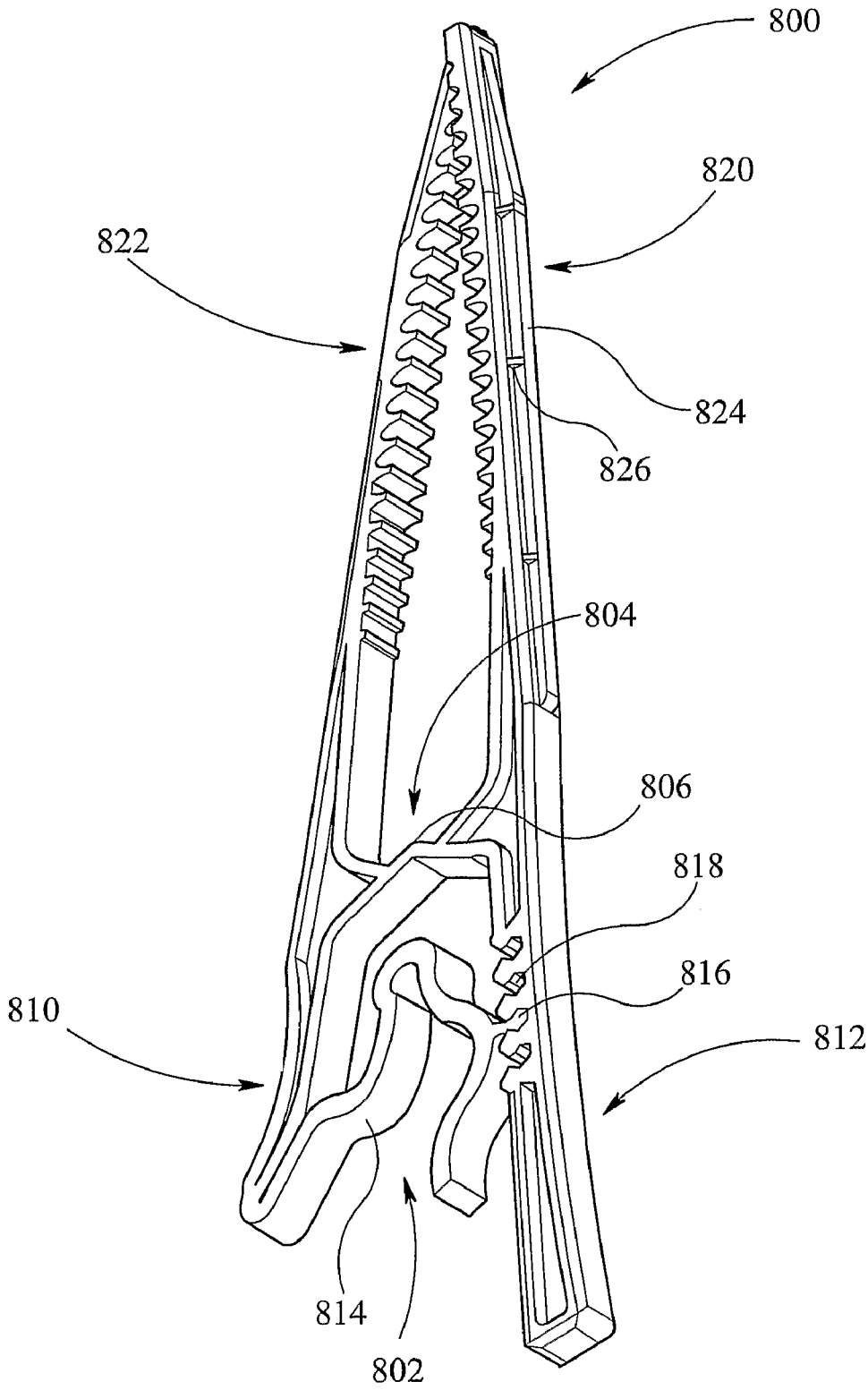
FIG. 18 shows a perspective view of an eating implement according to a further embodiment of the invention.

Referring to FIG. 18 an alternative embodiment of the sticks 800 is shown comprising a single plastic moulding. The sticks 800 function substantially as described herein but have a different spring 802 and pivot 804. The pivot 804 is provided by a live hinge 806 produced as part of the moulding process. The sticks 800 have one shorter handle 810 and one longer handle 812. The shorter handle 810 has a curved profile 814 extending therefrom which has a bulbed extension 816 extending therefrom. Once moulded the bulbed extension clips into one of a plurality of notches 818 in the longer handle in a position such that movement of the two handles 810, 812 towards one another will cause the curved profile 814 to flex thereby providing a restoring force urging the jaws 820, 822 towards one another. The bulbed extension 816 may be inserted into one of a plurality of notches 818, each notch providing a different restoring force on the jaws 820, 822. The sticks are made of an injection moulded plastic and have a spine 824 running along the length of the jaws having webs 826 extending therefrom to give support to the jaws 820, 822 of the sticks 800. The tips of the jaws may lock together as described above.

Figure 19:
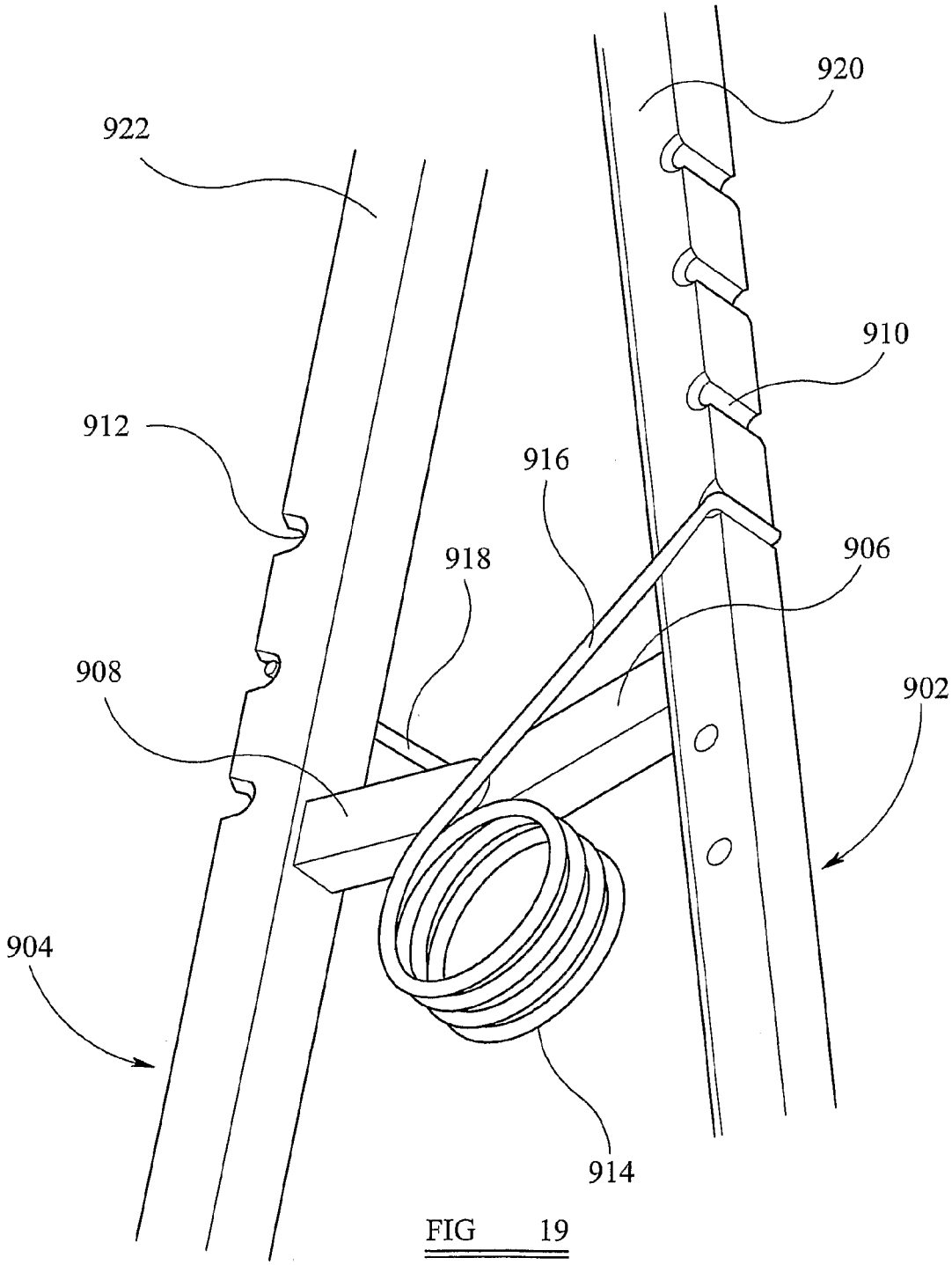
FIG. 19 shows a perspective view of an alternative hinge of an eating implement according to the invention.

Referring to FIG. 19, a close up of an alternative spring arrangement of the invention is shown. Each stick 902, 904 has a pivot support 906, 908 extending therefrom, one pivot support having an concave surface and the other having a convex surface such that the two supports may pivot relative one another on the surfaces. Each stick 902, 904 has at least one notch 910, 912 on its outer surface and a coil spring 914 has extensions 916, 918 that extend into the notches 910, 912. Tension in the spring holds the extensions 916, 918 in place and applies therethrough a force on the jaws 920, 922 of the sticks biasing them towards one another.

Figure 20:
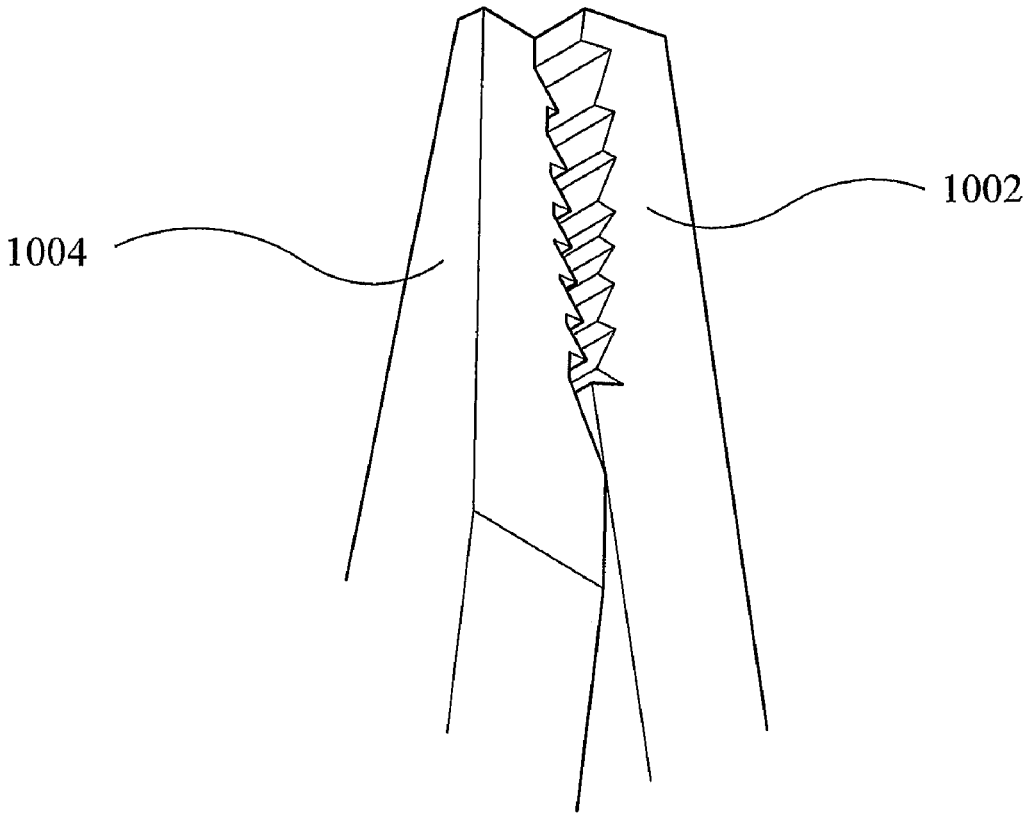
FIG. 20 shows a close up of an alternative design for the tips of an eating implement according to a further embodiment of the invention.

Referring to FIG. 20 an alternative design for the tips of the jaws 1002, 1004 is shown wherein, instead of the tips of the jaws being notched to allow them to interlock with one another, the sticks comprise one jaw with a wide end 1002 and one jaw with a narrow end 1004. The jaws are serrated on their inner surfaces and the serrations of the two jaws tessellate with one another in the tip region so as to keep them aligned.

Whilst all the embodiments of the present invention described above are described discretely, it is to be understood that features of any one embodiment are interchangeable with features of another embodiment as far as practicably possible. For example any or any combination of the shape of the plates, the notch formations, the relative length of the elongate members, the tapered nose formation and/or the teeth shown in FIGS. 14 to 16 may be combined with the features of any one of the embodiments of FIGS. 1 to 13.

The invention claimed is:

1. An implement for use in the consumption of food, said implement comprising a pair of elongate members having a first end for contacting the food and a second end for applying a pressure to operate the implement, which elongate members are pivotable with respect to each other; and means for urging the implement to a storing position wherein in the storing position the first ends of the elongate members are in close proximity to each other and the second ends are spaced apart so that as pressure is applied to the second ends of the elongate members the elongate members pivot with respect to each other separating the first ends and enabling food to be located there between so that when the pressure is released the food is gripped by the first ends of the elongate members and can be lifted, wherein one of the elongate members is pivotally mounted with respect to a plate member by a pivotal mounting provided at one edge of the plate member and the other elongate member is fixed to the plate member at an opposing edge of the plate member such that said other elongate member is rigidly held in position with regard to the plate member and is restrained against longitudinal movement relative to the plate member, the plate member thereby serving to maintain the elongate members in a spaced relationship in the vicinity of said pivotable mounting.

2. An eating implement as claimed in claim 1, wherein the elongate members are straight members that are caused to move with to respect to each other in the same plane.

3. An eating implement as claimed in claim 2, wherein the elongate members for a part of their length above the pivot point have the second ends of the elongate members displaced from said plane with respect to each other, and at least one of the second ends with respect to the plane of movement of the eating implement, sufficiently to enable the second ends to cross over.

4. An eating implement as claimed in claim 1, wherein the plate member is a double plate arrangement that sandwich the elongate members.

5. An eating implement as claimed in claim 4, wherein the double plate arrangement has a recess therein for retaining the means for urging said elongate members.

6. An eating implement as claimed in claim 1, wherein the means for urging the implement to the storing position comprises an elastically deformable member or members that are deformed by pressure applied during operation which pressure is stored and acts to urge the implement back to its storing position.

7. An eating implement as claimed in claim 6, wherein the means for urging the implement to the storing position comprises a spring.

8. An eating implement as claimed in claim 1, wherein either or both of the elongate members has teeth formations located towards the first end thereof.

9. An eating implement as claimed in claim 1, wherein either or both of the elongate members is tapered in the vicinity of its first end so as to form a nose section.

10. An eating implement as claimed in claim 1, wherein one of the elongate members is shorter in length than the other of said elongate members, such that the second end of the shorter elongate member contacts the longer elongate member part way along its length when the implement is in its openmost condition.

11. An eating implement according to claim 1, wherein the means for urging the implement to a storing position comprises a spring integrally moulded with the elongate members.

12. An eating implement according to claim 11, wherein the eating implement comprises a one piece plastics moulding.

13. An implement for use in the consumption of food, said implement comprising a pair of elongate members having a first end for contacting the food and a second end for applying a pressure to operate the implement, which elongate members are pivotable with respect to each other; and means for urging the implement to a storing position wherein in the storing position the first ends of the elongate members are in close proximity to each other and the second ends are spaced apart so that as pressure is applied to the second ends of the elongate members the elongate members pivot with respect to each other separating the first ends and enabling food to be located there between so that when the pressure is released the food is gripped by the first ends of the elongate members and can be lifted, wherein one of the elongate members is pivotally mounted with respect to a plate member and the other elongate member is fixed in position with regard to the plate member, the plate member serving to maintain the elongate members in a spaced relationship in the vicinity of said pivotable mounting, and wherein the means for urging the implement to the storing position comprises an elastically deformable member band that is located about the elongate members at a position between the pivot point and the first ends of the members and is deformed by pressure applied during operation which pressure is stored and acts to urge the implement back to its storing position.

14. An eating implement as claimed in claim 13, wherein the elongate members include a plurality of notches formed along their length between the pivot point and the first end to provide predetermined locations for receiving the band.

15. An implement for use in the consumption of food, said implement comprising a pair of elongate members having a first end for contacting the food and a second end for applying a pressure to operate the implement, which elongate members are pivotable with respect to each other; and means for urging the implement to a storing position wherein in the storing position the first ends of the elongate members are in close proximity to each other and the second ends are spaced apart so that as pressure is applied to the second ends of the elongate members the elongate members pivot with respect to each other separating the first ends and enabling food to be located there between so that when the pressure is released the food is gripped by the first ends of the elongate members and can be lifted, wherein one of the elongate members is pivotally mounted with respect to a plate member and the other elongate member is fixed in position with regard to the plate member, the plate member serving to maintain the elongate members in a spaced relationship in the vicinity of said pivotable mounting, and wherein the elongate members are provided with means at the first ends to help locate and secure the members with respect to each other.

16. An eating implement as claimed in claim 15, wherein the elongate members are provided with a groove and tongue type arrangement in which one member or a part of said member locates into a groove or indentation provided on the other member.

* * * * *